US008443639B2

(12) United States Patent
Walsh

(10) Patent No.: US 8,443,639 B2
(45) Date of Patent: May 21, 2013

(54) RESISTANT MECHANICAL COMBINATION LOCK AND IMPROVEMENTS THERETO

(75) Inventor: Michael J. Walsh, Chiloquin, OR (US)

(73) Assignee: Michael J. Walsh & Associates, Inc., Chiloquin, OR (US)

( * ) Notice: Subject to any disclaimer, the term of this patent is extended or adjusted under 35 U.S.C. 154(b) by 21 days.

(21) Appl. No.: 12/963,625

(22) Filed: Dec. 8, 2010

(65) Prior Publication Data

US 2012/0144884 A1 Jun. 14, 2012

(51) Int. Cl.
*E05B 37/08* (2006.01)

(52) U.S. Cl.
USPC ..... 70/303 A; 70/303 R; 70/333 R; 70/315; 70/327

(58) Field of Classification Search
USPC ..... 70/303 A, 303 R, 333 R, 314–318, 70/321, 323–327
See application file for complete search history.

(56) References Cited

U.S. PATENT DOCUMENTS

| | | | | | |
|---|---|---|---|---|---|
| 901,116 | A | | 10/1908 | Murphy | |
| 1,092,874 | A | | 4/1914 | Taylor | |
| 1,145,377 | A | | 7/1915 | Lewis | |
| 1,193,754 | A | | 8/1916 | Benham | |
| 1,484,692 | A | | 3/1921 | Weber | |
| 1,644,650 | A | | 4/1926 | Millice | |
| 2,494,575 | A | | 1/1950 | O'Brien | |
| 2,925,726 | A | * | 2/1960 | Miller | 70/333 R |
| 3,045,466 | A | | 7/1962 | Herlong | |
| 3,045,467 | A | | 7/1962 | Herlong | |
| 3,176,486 | A | | 4/1965 | Richardson | |
| 3,237,435 | A | * | 3/1966 | Paul | 70/323 |
| 3,339,382 | A | * | 9/1967 | Miller et al. | 70/23 |
| 3,427,413 | A | | 2/1969 | Hawkins | |
| 3,894,415 | A | * | 7/1975 | Bako | 70/21 |
| 3,980,844 | A | | 9/1976 | Bianco | |
| 3,981,167 | A | | 9/1976 | Phillips | |
| 3,991,596 | A | | 11/1976 | Gartner | |
| 4,312,199 | A | | 1/1982 | Uyeda | |
| 4,353,231 | A | | 10/1982 | Uyeda | |
| 4,576,024 | A | | 3/1986 | Weber | |
| 4,756,176 | A | | 7/1988 | Uyeda | |

(Continued)

OTHER PUBLICATIONS

International Searching Authority, "International Search Report" and related documents, search report for PCT/US2010/27005, dated May 5, 2011, 17 pages.

(Continued)

*Primary Examiner* — Suzanne Barrett
*Assistant Examiner* — David E Sosnowski
(74) *Attorney, Agent, or Firm* — Law Offices of Karen Dana Oster, LLC

(57) ABSTRACT

A resistant mechanical combination lock and improvements thereto are described herein to include one or more of the following features: an improved combination change/set feature that includes a tumbler interlocking lever with digitated micro-fingers suitable for interdigitating with digitated micro-fingers on the peripheral edge of a combination tumbler ring, the tumbler interlocking lever and the combination tumbler ring sandwiched between a pair of outer gate rings to form a tumbler wheel assembly; a key stabilization feature in which an internal boss and a pivot recess together help stabilize the change key when changing the combination of a lock to help prevent "lock out"; an improved duress feature that includes a duress tumbler wheel assembly (that includes a duress lever) and an interchangeable microswitch; and/or a fence control feature that preferably includes an overcenter spring and trigger plate for controlling fence contact with the drive cam.

29 Claims, 24 Drawing Sheets

U.S. PATENT DOCUMENTS

| | | | | | |
|---|---|---|---|---|---|
| 4,776,190 | A | * | 10/1988 | Miller et al. | 70/303 A |
| 4,796,446 | A | * | 1/1989 | Miller et al. | 70/316 |
| 4,831,851 | A | * | 5/1989 | Larson | 70/303 A |
| 5,343,723 | A | * | 9/1994 | Miller et al. | 70/303 A |
| 5,575,164 | A | * | 11/1996 | Ohsawa | 70/303 A |
| 5,592,838 | A | * | 1/1997 | Clark et al. | 70/303 A |
| 5,632,170 | A | | 5/1997 | Evans | |
| 5,893,283 | A | * | 4/1999 | Evans et al. | 70/303 A |
| 6,038,897 | A | * | 3/2000 | Dawson et al. | 70/303 A |
| 6,298,699 | B1 | * | 10/2001 | Gartner et al. | 70/278.1 |
| 6,813,917 | B2 | * | 11/2004 | Miller et al. | 70/303 A |
| 6,904,778 | B2 | | 6/2005 | Jasper | |
| 7,216,518 | B2 | * | 5/2007 | Shao | 70/303 A |
| 7,975,517 | B2 | * | 7/2011 | Liu et al. | 70/292 |
| 2002/0056300 | A1 | * | 5/2002 | Pierre et al. | 70/303 A |
| 2004/0211233 | A1 | | 10/2004 | Jasper | |
| 2005/0081583 | A1 | * | 4/2005 | Miller et al. | 70/303 A |
| 2007/0289347 | A1 | * | 12/2007 | Miller et al. | 70/303 A |

OTHER PUBLICATIONS

Underwriters Laboratories, Inc., UL Standard for Safety Combination Locks, Manual, Jan. 6, 2006, 18 pages, vol. 768, Published by Underwriters Laboratories, Inc., Northbrook, IL, USA.

Lee Spring, Extension Spring Specifications, Web Catalog, retrieved Feb. 16, 2010, 1 page, published online by Lee Spring.

Michael J. Walsh & Associates, Inc., Big Red Safe Locks, Catalog, Aug. 12, 2010, 16 pages, published by Michael J. Walsh & Associates, Inc., Chiloquin, Oregon, USA.

International Searching Authority, "International Search Report and Written Opinion" and related documents for PCT/US2011/027005, dated May 5, 2011, 16 pages.

International Searching Authority, "International Preliminary Report on Patentability" for PCT/US2011/027005, dated May 24, 2012, 26 pages.

Myers, Matthew, "Big Red Safe Locks," The National Locksmith, vol. 83, No. 6, Jun. 2012, 4 pages.

* cited by examiner

200

RESISTANT MECHANICAL COMBINATION LOCK AND IMPROVEMENTS THERETO

BACKGROUND OF INVENTION

This invention is related to mechanical combination locks. In more specificity, the invention relates to resistant mechanical combination locks and improvements thereto (generally referred to herein as the "locking system").

In many technical arts, mechanical devices have been superseded by their electronic digital counterparts. The mechanical combination lock (also referred to herein as "combination locks," "locks," and "mechanical locks"), however, is time-tested and finds broad use in applications where there may be exposure to moisture or where a backup power supply is not readily available. These applications include, for example, commercial and home safes, vaults, and automated cash machines.

Combination locks, by way of introduction and example, include a plurality (e.g. three or four) wheels, each wheel having a first surface, a second surface, and a peripheral edge. Each wheel's peripheral annular edge has at least one "notch" (also referred to as a "tumbler gate," "wheel gate," or "gate") thereon. The "wheels" are also referred to as "tumbler wheels," "tumblers," "tumbler assemblies," "wheel assemblies," "tumbler wheel assemblies," "tumbler rings," or "gate wheels." Together wheels are generally jointly referred as the "tumbler stack," "tumbler pack," "wheel stack," or the "wheel pack." In general, more wheels included in a combination lock make the lock more secure. A "spindle" (also referred to as a "drive shaft") has a "combination dial" (also referred to as "dial" or "dial plate") substantially at one end and a "drive cam" (that has at least one "drive cam gate," "cam gate," or "gate" on its peripheral annular edge) substantially at the other end. The wheels are positioned around a hub through which the drive shaft is positioned, the wheels being between the combination dial and the drive cam, with the wheel closest to the combination dial being referred to (by convention) as the #1 (or first) wheel, the wheel adjacent the #1 wheel being referred to (by convention) as the #2 (or second) wheel, the wheel adjacent the #2 wheel being referred to (by convention) as the #3 (or third) wheel, and, if present, the wheel adjacent the #3 wheel being referred to (by convention) as the #4 (or fourth) wheel. For purposes of description only, the first surface of each wheel is the surface facing the combination dial and the second surface of each wheel is the surface facing the drive cam. The drive cam has a "drive pin" (an engager such as a raised element, tab, or bump) on it that matches a "wheel fly" (an engager such as a raised element, tab, or bump suitable for interacting with an adjacent drive pin) on the second surface of the #3 wheel (the wheel adjacent to the drive cam, which could also be the #4 wheel if a fourth wheel is present). Each wheel, except the #1 wheel, has a drive pin on its first surface that matches an adjacent wheel fly on the second surface of an adjacent wheel (or the drive cam). The #1 wheel has a wheel fly on its second surface, but does not have a drive pin. When the combination dial is turned (also referred to as "rotated" or "spun"), it rotates the drive shaft and the attached drive cam. When the drive pin on the drive cam interacts with the wheel fly on the adjacent wheel (the #3 wheel in this example), that wheel begins rotating. When the #3 wheel's drive pin interacts with the wheel fly on the adjacent #2 wheel, that wheel begins rotating. When the #2 wheel's drive pin interacts with the wheel fly on the adjacent #1 wheel, that wheel begins rotating. In other words, the sequence repeats so that the adjacent drive pins and wheel flies interact (becoming properly aligned) until all the wheels are rotating together in response to the rotating of the combination dial. This process is called "picking up the wheels" because after several spins, all the drive pins and wheel flies will be matched up and all the wheels will be spinning. When a user stops rotating the dial and turns the dial the other way, the first wheel (the #1 wheel) is left in place. When direction of the rotation changes again, the second wheel (the #2 wheel) is left in place, and so on. When all the wheels have been left in the correct position, the tumbler gates will be aligned and the drive cam gate will be aligned after an additional rotation. Over the wheels rests a bar called the "fence." The fence stops the lock from being opened by preventing the lever arm nose from engaging the drive cam gate. When the gates in all the wheels are aligned, the fence falls into the slot formed by the aligned gates, allowing the lock to be opened. In other words, the "combination" is reached when the gates in the wheels are aligned.

Combination locks are often described by how many wheels they have. In general, more wheels included in the lock make the lock more secure. In general, for each wheel there is one number in the combination. A combination lock with three wheels, for example, may be referred to as a "three wheel combination lock." A three wheel combination lock would have three numbers in its combination. Three wheel and four wheel combination locks typically have up to 100 digits on the dial face and thus can provide $10^6$ to $10^8$ permutations for use as a combination.

Persons using combination locks will typically change the combination to a set of numbers known only to them, and in this process can inadvertently fail to set the combination precisely, firmly, and/or correctly, so that the desired combination does not work after the structure to which the lock is attached (e.g. a safe) is closed. Dirt, oils, other residues, or wear on the mechanism can also result in a slipped combination, resulting in what is known in the trade as a "lock out," where an individual is unable to open his own lock or safe. Restoring access is expensive, disruptive, and requires the services of a professional safe technician (e.g. a locksmith). To avoid this, users are advised to test a new combination several times before closing the lock, but professional safe technicians have found steady work as a result of user haste and slipped or damaged tumblers. Thus there is a need for the ability to more reliably change a combination and yet be able to resist slippage, grit, or residues, and also centrifugal force. A good measure of slip resistance, albeit a destructive test, is a torque test applied to a tumbler wheel assembly. Industry standards perform at up to about 50 or 60 inch-pounds of torque at failure, the point at which the interlock between the gate rings and the combination tumbler ring is lost.

Also of interest in comparing combination locks is an endurance dialing test, where an automated dialer repeatedly rapid dials the combination until it wears out or fails for lack of service. A typical industry benchmark for a high-speed endurance dialing test is about 10,000 complete cycles to failure.

The interlock lever arms or pawls of industry standard combination locks are typically provided with teeth that have not changed much since early patents such as U.S. Pat. No. 901,116 to Murphy (the "Murphy reference") and U.S. Pat. No. 1,484,692 to Weber (the "Weber reference"). The Murphy reference addresses the issue of the permanence of any adjustment to the combination and proposes a locking dog with inner edge toothed and concaved to conform to the curvature of the outer peripheral edge of the combination tumbler ring it opposes when urged into contact by a rotatable cam. As shown, the locking dog and combination tumbler ring are supplied with sawtooth-shaped teeth. Similarly, the Weber reference discloses a spring-operated lever and tooth surface of a combination wheel, which allows the user having a special change key (cam key) to change the combination when the safe is open. The Weber lever, when the wheel is spun rapidly, may be lifted away from the combination tumbler ring, scrambling the combination set by the user.

U.S. Pat. No. 3,981,167 to Phillips (the "Phillips reference") again addresses the problem of changing the "combination" for the lock, and provides (see FIGS. 9-10 of the Phillips reference) a locking pawl with pawl teeth. Once the desired orientation between the drive wheel ring and the tumbler ring is accomplished, the pawl is engaged against the drive teeth for holding the two rings together during concurrent rotation. The teeth are generally saw-shaped.

U.S. Pat. No. 3,991,596 to Gartner (the "Gartner reference") discloses using a locking lever with saw-shaped teeth to secure the tumbler. The art is characterized as follows: "The tumbler wheels 20 generally resemble the changeable tumbler wheels usually employed in combination locks, in that they comprise an inner hub 21 having a serrated outer periphery that is engaged by similar teeth on the jaw formation 22 of a resilient interlocking lever 23 of peripheral or rim portions 24 of the tumbler wheels each having a tumbler gate or peripheral recess 20a therein."

U.S. Pat. No. 4,312,199 to Uyeda (the "Uyeda '199 reference") adopts a similar approach, disclosing use of opposing teeth to position a drive member with respect to plastic gate ring (FIGS. 6-8 of the Uyeda '199 reference). The teeth are generally saw-shaped and are not believed to be durable and slip resistant. In U.S. Pat. No. 4,353,231 (the "Uyeda '231 reference"), Uyeda addresses the problem differently, using frictional effects between opposing undulating surfaces to prevent slippage.

U.S. Patent Application Publication No. 2004/0211233 to Jasper (the "Jasper reference"), discloses a key-operated combination change mechanism having four arcuate inner spring arms, each provided with saw-shaped teeth for meshing with teeth on the wheel rings (see paragraph 0062 of the Jasper reference).

Thus it appears that the art as a whole solves the problem of frictional interlocking contact between outer gate rings by interposing teeth having a saw-shaped, serrated, or undulating profile and/or beveled tooth faces. These teeth, by their nature, have surfaces that will tend to ride up on each other when subject to force, are inherently prone to slippage, and, as shown by experience, will generally fail when subjected to 50-60 inch-pounds or less of rotational torque. These tooth designs also are prone to "lock out" when subjected to deposits of grit or other residues that gradually lift the teeth apart.

Finally, it is also known that a combination lock can be defeated by an armed robber using intimidation (duress) to force an individual to dial the combination, or by a very skilled lock manipulator, who senses subtle changes in the smooth operation of the dial to divine all or part of the combination. Many combination locks can be opened by knowing only an approximate combination and by vibrating the dial to drop the fence into the gates.

These problems and other disadvantages of current designs are addressed by the present invention.

BRIEF SUMMARY OF THE INVENTION

This invention is related to mechanical combination locks. In more specificity, the invention relates to resistant mechanical combination locks and improvements thereto and is generally referred to herein as the "locking system." Preferred locking systems described herein include one or more of the following features:

- an improved combination change/set feature (a DEAD-LOC TECHNOLOGY™ feature) that includes a tumbler interlocking lever with digitated micro-fingers suitable for interdigitating with digitated micro-fingers on the peripheral edge of a combination tumbler ring, the tumbler interlocking lever and the combination tumbler ring sandwiched between a pair of outer gate rings to form a tumbler wheel assembly;
- a key stabilization feature in which an internal boss and a pivot recess together help stabilize the change key when changing the combination of a lock to help prevent "lock out";
- an improved duress feature that includes a duress tumbler wheel assembly (that includes a duress lever) and an interchangeable microswitch; and/or
- a fence control feature (a SOFT TOUCH™ feature) that preferably includes an overcenter spring and trigger plate for controlling fence contact with the drive cam.

The combination change/set feature, key stabilization feature, improved duress feature, and fence control feature may be used individually or combined.

A preferred method for forming an interlock lever arm of a combination lock, the interlock lever arm with micro-fingers includes the steps of: (a) designing a first micro-finger by drawing two concentric circles around a center, an inside circle with radius R and an outside circle with radius R', wherein the radius R is the desired radius of a combination tumbler ring, and the difference between R and R' is the desired height of the micro-finger; (b) intersecting the concentric circles with least two radial projections separated by an arc corresponding to the width of the desired micro-finger, the radial projections defining flanking flats of the micro-finger; (c) drawing a convex curvature on the crown of the micro-finger, the crown facing the center and smoothly joining the flanking flats; (d) drawing a second micro-finger, wherein the first and second micro-fingers are joined at the root by a concave curvature mirroring the convex curvature of the crown; (e) continuing to draw micro-fingers around the full circumference, thereby forming a curve representing, in negative space between the micro-fingers, a full profile of a digitated combination tumbler ring circumference; (f) subtracting a clearance from the full profile and drawing outside the concentric circles but intersecting in an arc therewith, a lever shape of an interlock lever arm having an arcuate member with concave radius R', the arcuate member having drawn thereon a row of the micro-fingers, wherein the micro-fingers of the lever arm are configured for interdigitatingly engaging the digitated combination tumbler ring circumference, the lever shape further having a fulcrum configured thereon; and (g) forming the interlock lever arm by punching the lever shape from sheet stock, the lever shape having a row of micro-fingers arcuately disposed thereon. The method may further include the step of forming the interlock lever arm to have an arcuate member with concave radius R of about or slightly greater than 1.25 centimeters, a micro-finger height of about 0.65 millimeters, and a micro-finger width of about 1 degree of arc.

A preferred combination lock with a combination dial operatively linked to a drive cam and a plurality of tumbler wheel assemblies rotatably stacked on a hub to form a tumbler stack within a lock case, each of the tumbler wheel assemblies having a tumbler gate, the drive cam having a drive cam gate for engaging a nose of a pivotable fence lever arm, the fence lever arm for retracting a slideable lock bolt when a correct combination is dialed, and an interlock mechanism in each of the plurality of tumbler wheel assemblies, the combination lock includes: (a) a combination tumbler ring having an inside radius for engaging the hub and a circumference digitated with micro-fingers, the circumference with radius R' at the root of the micro-fingers and radius R at the crown of the micro-fingers; and (b) at least one interlock lever arm with a fulcrum for opposingly contacting the circumference of the combination tumbler ring, the interlock lever arm with first end having a plurality of micro-fingers disposed on an arcuate member with concave radius R, the micro-fingers of the interlock lever arm for interdigitatingly engaging the circumferential micro-fingers of the combination tumbler ring in a gripping action, wherein the circumferential fingers and the interlock lever arm micro-fingers are formed with opposable crowns and roots and opposable flat-on-flat flank faces for cooperatively resisting rotational torque applied thereto when interdigitatedly engaged.

In a preferred combination lock such as that described above (although not limited thereto), the fulcrum may be disposed between a first end and a second end of the interlock lever arm, and the interlock mechanism further includes a rotating lug cam for applying a force to the second end for leveraging the gripping action.

In a preferred combination lock such as that described above (although not limited thereto), the first end of the interlock lever arm further includes a spring arm member for biasing the arcuate member to disengage the gripping action when the rotating lug cam force is not applied.

In a preferred combination lock such as that described above (although not limited thereto), the interlock mechanism includes a pair of interlock lever arms, and the fulcrum of each of the interlock lever arms of the pair is configured for cooperatively exerting a gripping pincer action on the combination tumbler ring when actuated by the lug cam.

In a preferred combination lock such as that described above (although not limited thereto), the interlock mechanism of the tumbler wheel assemblies being configured for resisting greater than 100 inch-pounds of rotational torque on the spline when interdigitatedly engaged.

In a preferred combination lock such as that described above (although not limited thereto), the micro-fingers of the interlock lever arm and combination tumbler ring being dimensioned with a clearance of at least 0.001 inches.

In a preferred combination lock such as that described above (although not limited thereto), the lock case is provided with a lock case lid and the lock case lid is configured with a keyhole for receiving a winged change key, the keyhole having an internal boss for stabilizing alignment of the change key during use.

In the combination lock described above, any one of the plurality of tumbler wheel assemblies is configured as a duress tumbler wheel assembly for actuating an alarm, the duress tumbler wheel assembly being associated with a microswitch module associated with a rollerswitch for operatively contacting the duress tumbler wheel assembly.

In a preferred combination lock such as that described above (although not limited thereto), the microswitch module with rollerswitch is at least partially encompassed in a microswitch assembly, the microswitch module positionable within the microswitch assembly in a position corresponding to the position of the duress tumbler wheel assembly.

In a preferred combination lock such as that described above (although not limited thereto), the microswitch module with rollerswitch is at least partially encompassed in a microswitch assembly. The microswitch assembly further includes interchangeable spacer blocks configured so that the microswitch module can be changeably positioned in operative relation to a duress tumbler assembly at any level of the tumbler stack.

In a preferred combination lock such as that described above (although not limited thereto), the duress tumbler wheel assembly may further include: (a) a duress gate on a peripheral edge thereof; (b) a Y-shaped duress lever arm that includes a first end including a first branch with a shoulder and a resilient spring tine second branch and a blocking arm second end; (c) a pivot pin generally at a midpoint between the first end and the second end; and (d) the cam shoulder having a concealed position and an exposed position, resilient spring tine second branch for urging the cam shoulder to the concealed position within the tumbler wheel assembly.

In a preferred combination lock such as that described above (although not limited thereto), the blocking arm second end is positioned to occlude the duress gate when the cam shoulder is in the concealed position, and rotatingly urges the cam shoulder to the exposed position when displaced from the duress gate by the action of the fence dropping into the duress gate, and further wherein the rotation can be reversed by the action of the spring tine without triggering an alarm.

In a preferred combination lock such as that described above (although not limited thereto), the blocking arm second end is positioned to occlude the duress gate when the cam shoulder is in the concealed position, and rotatingly urges the cam shoulder to the exposed position when displaced from the duress gate by the action of the fence dropping into the duress gate.

In a preferred combination lock such as that described above (although not limited thereto), the rollerswitch of the microswitch module is operatively engaged by the cam shoulder in the exposed position when the lock mechanism is rotated to retract the lock bolt, thereby triggering an alarm by closing an electrical circuit.

The preferred combination lock described above may further include: (a) an excentric trigger pin mounted on an outside face of the drive cam; and (b) a trigger plate pivotably mounted at a fulcrum on the lock case, the trigger plate having an overcenter arm, a stop arm, and a cam follower arm disposed around a common pivot point on the housing (lock case), wherein the overcenter arm is operatively coupled to the fence lever arm by a coil spring such that the nose is normally biased to a first position raised above the drive cam and drops down toward the drive cam gate in a second position for less than 35 degrees of rotational arc when resiliently urged by the excentric trigger pin acting on the cam follower arm.

In a preferred combination lock such as that described above (although not limited thereto), the trigger plate may further include: (a) a bracket for mounting the overcenter spring, wherein the bracket is vertically elevated above the overcenter arm and displaced counterclockwise from the rotational line of the overcenter arm by a distance of about 4 millimeters, the clockwise displacement reducing the stretch of the spring and sharpening the transitional arc from first position to second position; (b) a half-moon-shaped apron formed on the overcenter arm, the half-moon-shaped skirt extending under the coil spring and over the nose and the drive cam gate; (c) a plastic body, generally formed of nylon with glass fill, having translucency, resilience, and increased resistance to wear; and (d) a stop arm having a pendant stop dog for opposing the lock case.

In a preferred combination lock such as that described above (although not limited thereto), the trigger plate may further include at least one feature selected from the group consisting of: (a) a bracket for mounting the overcenter spring, wherein the bracket is vertically elevated above the overcenter arm and displaced counterclockwise from the rotational line of the overcenter arm by a distance of about 4 millimeters, the clockwise displacement reducing the stretch of the spring and sharpening the transitional arc from first position to second position; (b) a half-moon-shaped apron formed on the overcenter arm, the half-moon-shaped skirt extending under the coil spring and over the nose and the drive cam gate; and (c) a plastic body, generally formed of nylon with glass fill, having translucency, resilience, and increased resistance to wear.

The foregoing and other objectives, features, combinations, and advantages of the invention will be more readily understood upon consideration of the following detailed description of the invention, taken in conjunction with the accompanying drawings.

BRIEF DESCRIPTION OF THE SEVERAL VIEWS OF THE DRAWINGS

The accompanying drawings illustrate various exemplary locking systems and features thereof and/or provide teachings by which the various locking systems and features thereof are more readily understood. These drawings are incorporated in and constitute a part of this specification.

In FIG. 7B a duress tumbler wheel assembly is partially disassembled to show the protruding duress cam shoulder for actuating the microswitch.

Figure 1:
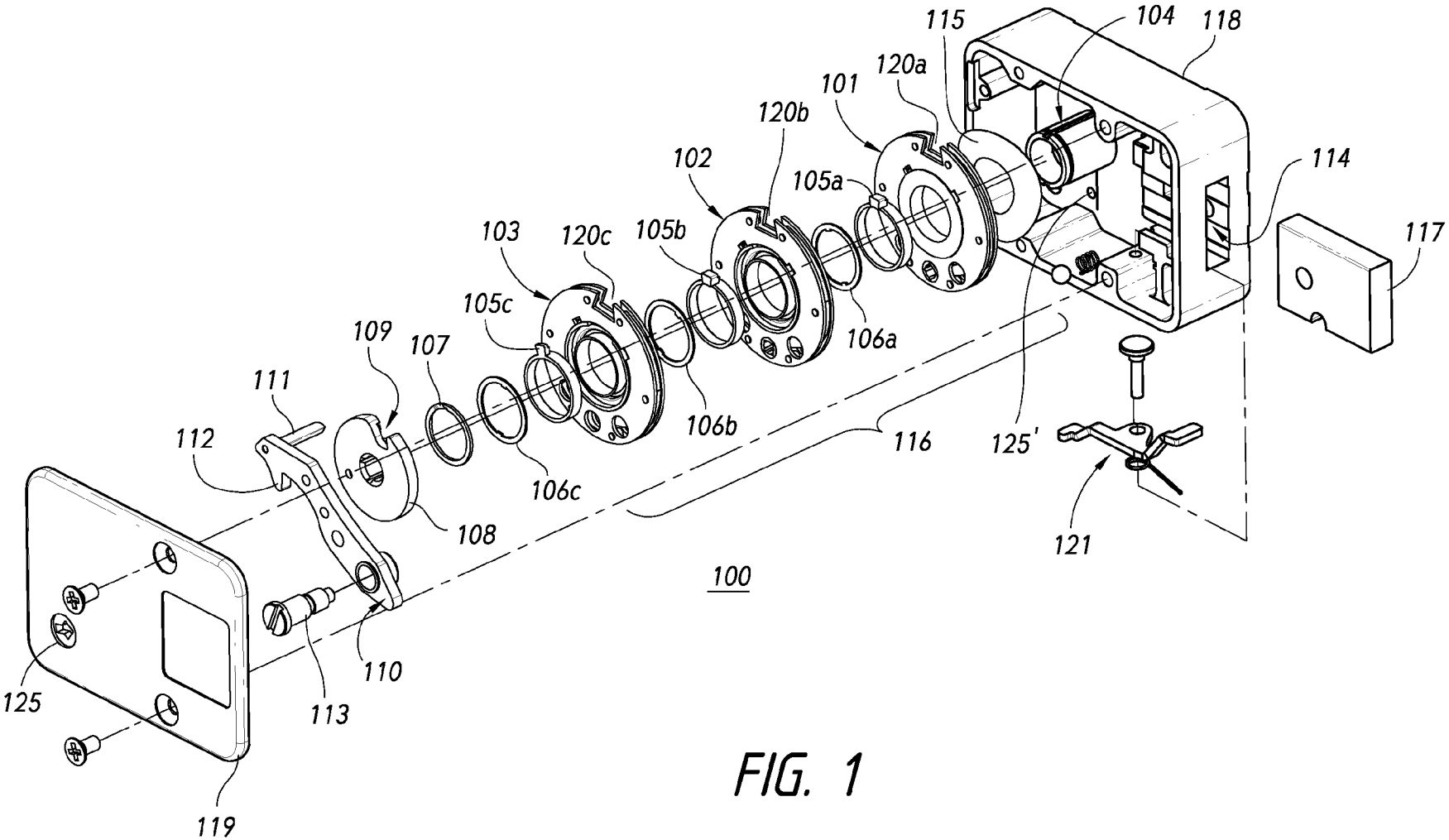
FIG. 1 is an exploded view of a generally representative combination lock with three tumbler wheel assemblies.

The drawing figures are not necessarily to scale. Certain features or components herein may be shown in somewhat schematic form and some details of conventional elements may not be shown or described in the interest of clarity and conciseness. The drawing figures are hereby incorporated in and constitute a part of this specification.

DETAILED DESCRIPTION OF THE INVENTION

This invention is related to mechanical combination locks. In more specificity, the invention relates to resistant mechanical combination locks and improvements thereto and is generally referred to herein as the "locking system." Preferred locking systems described herein include one or more of the following features:

- an improved combination change/set feature (a DEAD-LOC TECHNOLOGY™ feature) that includes a tumbler interlocking lever with digitated micro-fingers suitable for interdigitating with digitated micro-fingers on the peripheral edge of a combination tumbler ring, the tumbler interlocking lever and the combination tumbler ring sandwiched between a pair of outer gate rings to form a tumbler wheel assembly;

a key stabilization feature in which an internal boss and a pivot recess together help stabilize the change key when changing the combination of a lock to help prevent "lock out";

an improved duress feature that includes a duress tumbler wheel assembly (that includes a duress lever) and an interchangeable microswitch; and/or a fence control feature (a SOFT TOUCH™ feature) that preferably includes an overcenter spring and trigger plate for controlling fence contact with the drive cam.

Before describing the locking system and the figures, some of the terminology is reviewed. Certain terms are used herein to refer to particular features, steps or components, and are used as terms of description and not of limitation. As one skilled in the art will appreciate, the same feature, step, or component may be referred to by different names. Components, steps, or features that differ in name but not in function or action are considered equivalent and not distinguishable, and may be substituted herein without departure from the invention. Certain meanings are defined here as intended by the inventors, i.e. they are intrinsic meanings. Other words and phrases used herein take their meaning as consistent with usage as would be apparent to one skilled in the relevant arts. The following definitions supplement those set forth in the Background and other sections of this specification.

Digitated—refers to a surface having a plurality of finger-like projections forming a row of fingers or tines.

Interdigitated—(verb "interdigitating" and adverb "interdigitatingly") refers to the interlocking of a first surface and a second surface, each surface having a plurality of finger-like projections (fingers or digitated micro-fingers), the male and female aspects of the two surfaces contactingly interlocking in a palisading row where a finger of the first surface alternates with a finger of the second surface.

Tumbler wheel assembly (also referred to by other terms including "wheel," "tumbler," "tumbler assembly," "wheel assembly," "tumbler wheel," "tumbler ring," or "gate wheel")—refers to a composite structure generally having outer gate rings including a combination tumbler ring (also referred to as a "combination ring") sandwiched between a pair of gate rings. The gate rings are riveted together (with the combination tumbler ring therebetween) to form a tumbler wheel assembly that may rotate freely therebetween on a common center. In normal use, the gate rings and combination tumbler ring are disengageably locked in position at one or more opposing surfaces (along the peripheral edge of the combination tumbler ring that has digitated micro-fingers), thus fixing the combination. The peripheral edge of each gate ring is cut with one or more gates, the gates in a pair of gate rings corresponding with each other. The combination tumbler ring and the gate rings include a central annulus and are designed to slide onto a hub (also referred to as a post or arbor) that surrounds the drive shaft (not shown) of the combination lock. The tumbler wheel assemblies, combination dial, and drive cam preferably have a common central axis. The outer face surfaces of the combination tumbler rings make up the first surface and a second surface of a tumbler wheel assembly and have a drive pin or a wheel fly, respectively, that function as described in the Background. Also sandwiched between the gate rings is a micro-fingered interlock component, here illustrated as an arcuate lever (also referred to as a "tumbler interlocking lever," "interlock lever arm," "interlocking lever," or "locking lever arm") with a first end having a row of digitated micro-fingers for engaging complementary digitated micro-fingers on the combination tumbler ring. A lug cam is positioned between the gate rings to operatively disengage the interdigitated fingers so that the combination can be changed. The lug cam is operated with a change key and is generally accessible by inserting the change key through a keyhole in the lock case lid of the lock for ease of use.

Interlock mechanism—the interdigitating structure and interaction of the digitated micro-fingers of at least one tumbler interlocking lever with the digitated micro-fingers on the peripheral edge of a combination tumbler ring.

General connection terms including, but not limited to "connected," "attached," and "affixed" are not meant to be limiting and structures so "associated" may have other ways of being associated.

Relative terms should be construed as such. For example, the term "front" is meant to be relative to the term "back," the term "upper" is meant to be relative to the term "lower," the term "vertical" is meant to be relative to the term "horizontal," and the term "top" is meant to be relative to the term "bottom."

Unless specifically stated otherwise, the terms "first," "second," "third," and "fourth" are meant solely for purposes of designation and not for order or limitation. Similarly, unless specifically stated otherwise, the terms "#1," "#2," "#3," and "#4," are meant solely for purposes of designation and not for order or limitation.

Reference to "one embodiment," "an embodiment," or an "aspect," means that a particular feature, structure or characteristic described in connection with the embodiment or aspect is included in at least one realization of the present invention. Thus, the appearances of the phrases "in one embodiment" or "in an embodiment" in various places throughout this specification are not necessarily all referring to the same embodiment and may apply to multiple embodiments. Furthermore, particular features, structures, or characteristics of the invention may be combined in any suitable manner in one or more embodiments.

It should be noted that the terms "may" and "might" are used to indicate alternatives and optional features and only should be construed as a limitation if specifically included in the claims. It should be noted that the various components, features, steps, or embodiments thereof are all "preferred" whether or not it is specifically indicated. Claims not including a specific limitation should not be construed to include that limitation.

It should be noted that, unless otherwise specified, the term "or" is used in its nonexclusive form (e.g. "A or B" includes A, B, A and B, or any combination thereof, but it would not have to include all of these possibilities). It should be noted that, unless otherwise specified, "and/or" is used similarly (e.g. "A and/or B" includes A, B, A and B, or any combination thereof, but it would not have to include all of these possibilities). It should be noted that, unless otherwise specified, the term "includes" means "comprises" (e.g. a device that includes or comprises A and B contains A and B but optionally may contain C or additional components other than A and B). It should be noted that, unless otherwise specified, the singular forms "a," "an," and "the" refer to one or more than one, unless the context clearly dictates otherwise.

"Conventional"—refers to a term or method designating that which is known and commonly understood in the technology to which this invention relates.

Unless the context requires otherwise, throughout the specification and claims that follow, the term "comprise" and variations thereof, such as, "comprises" and "comprising" are to be construed in an open, inclusive sense that is as "including, but not limited to."

The appended claims are not to be interpreted as including means-plus-function limitations, unless such a limitation is explicitly recited in a given claim using the phrase "means for."

In general, the inventive features set forth herein may be described as addressing one or more of a pair of problems. First, the preferred locking systems preferably address the problem of increasing the strength and reliability of the preferred locking systems. Second, the preferred locking systems preferably address the problem of crime prevention.

With regard to the first problem of increasing the strength and reliability of the preferred locking systems, the locking systems described herein have been tested using high-speed repetitive autodialing machines (i.e. cycling at more than 300 cycles per minute), which cycle the combination automatically, and have been found to endure more than 15,000 consecutive openings, in some cases as many as 75,000 openings, in contrast to other conventional locks that have been found to fatigue or fail at about 5,000 to 10,000 openings.

With regard to the second problem of crime prevention, preferred locking systems described herein are able to prevent crimes or provide relief from crimes. These crimes are usually committed by the "cracking" of a combination lock by skillful manipulation or by the inflicting of duress on those with knowledge of the combination.

Preferred locking systems described herein solve these problems and other problems simultaneously because the enabling features are both subtle and strong; "subtle" for operation without obvious signs that reveal the combination to a skilled touch or alert the perpetrator that an alarm has been sounded, and "strong" for resisting brute force and abuse over an extended lifetime. Preferred locking systems are resistant mechanical combination locks that have one or more improvements that, alone or in combination, solve known problems of conventional combination locks.

One preferred locking system described herein is a mechanical combination lock having an improved combination change/set feature for changing the combination. Another preferred locking system described herein has an improved duress assembly and function that permits the user to select any of up to four tumbler wheel assemblies for the location of a duress microswitch. Yet another preferred locking system described herein has an improved fence control feature, where a trigger plate with a cam follower arm and an overcenter spring is positioned to drop the fence precisely into the drive cam gate only when the correct combination has been dialed and the tumbler wheel assemblies are properly aligned. Finally, preferred locking systems described herein include more than one of these features and/or other features that may be used in combination or separately to improve the performance of mechanical combination locks.

Combination Change/Set Feature:

As shown in FIGS. 1-4, the improved combination change/set feature increases the reliability of preferred locking systems in that it is harder to make errors changing the combination using locking systems having this feature. Further, some of the structure used to implement the feature increases the strength of the preferred locking systems. The structure central to the change/set feature is an interlock mechanism that includes at least one improved tumbler interlocking lever (132, 133) with digitated micro-fingers (135) suitable for interdigitating with digitated micro-fingers (131') on the peripheral edge of a combination tumbler ring (131). Rotating a change key (122) inserted into a lug cam (124) changes the orientation of the lug cam (124) from horizontal to vertical which, in turn, causes the digitated micro-fingers (135) of the tumbler interlocking lever(s) to disengage from the digitated micro-fingers (131') of the combination tumbler ring (131).

Figure 2A:
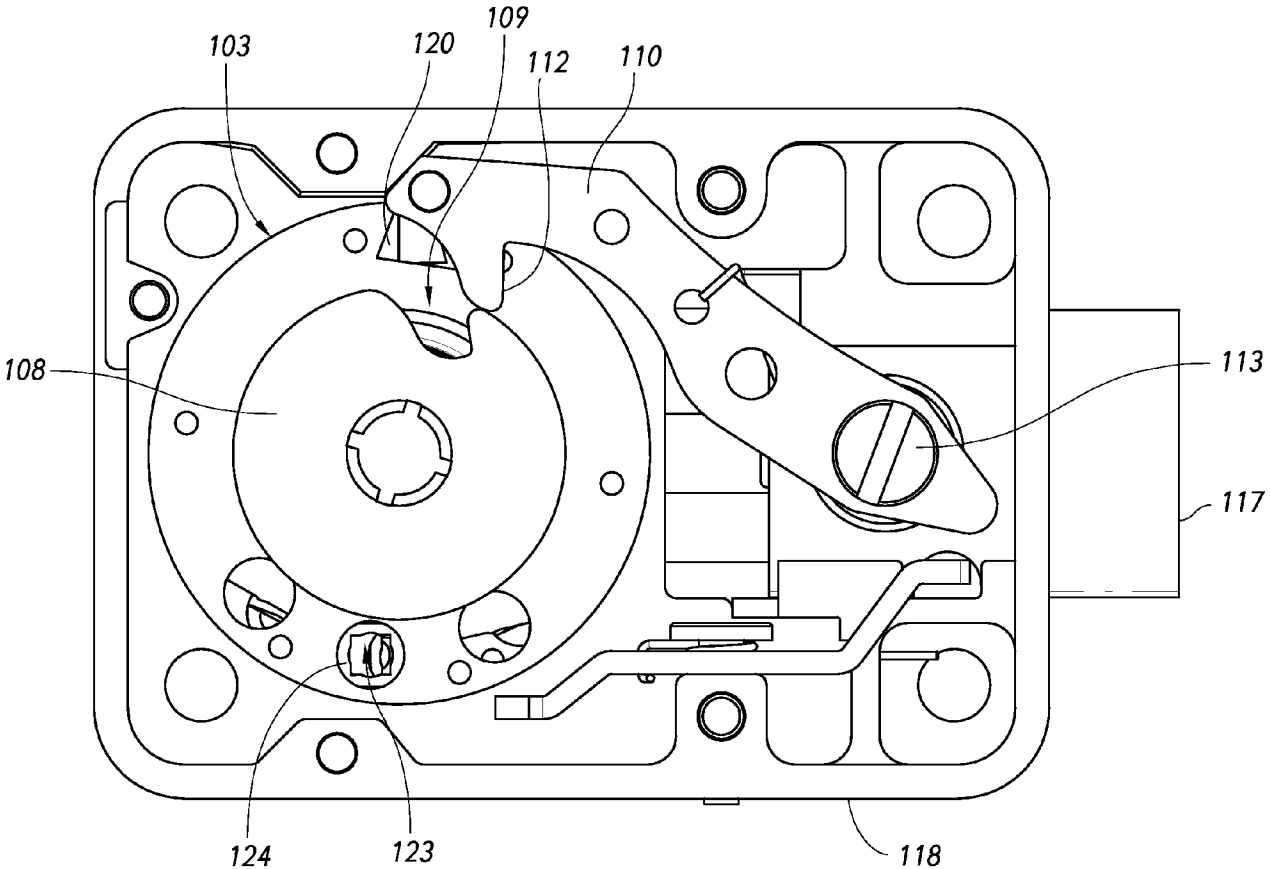
FIG. 2A is a front view of the combination lock of FIG. 1.

A change key (122) (FIG. 2D) is preferably used to initiate the change of a combination of a lock. Prior to inserting the change key (122) into the lock, a keyway (123) (through the tumbler wheel assemblies (101, 102, 103 as shown in FIG. 2A) is aligned with the keyhole (125) in the case lid (119) of the lock. The change key (122) is inserted into a keyhole (125), the surrounding internal boss (126), the keyway (123) (FIG. 2A), and a pivot recess (125') in the base of the lock case. The keyway (123) actually passes through the center of a lug cam (124) positioned between (or, if there is only one, adjacent to) the base end(s) (139) of the tumbler interlocking lever(s) (132, 133) (FIG. 4A) in each wheel assembly (101, 102, 103). Rotating the change key (122) within the keyway (123) causes the change key to interact with the inner surfaces of the lug cams and, thereby, changes the orientation of the lug cams (124). The lug cams (124) act upon the lower base ends (139) of the interlock lever arms (132, 133) which, through mechanical translation, cause the digitated micro-fingers (135) to disengage from the digitated micro-fingers (131') so that the combination of the lock can be changed.

FIGS. 1-4 show exemplary structures that may be used to implement the improved change/set feature.

FIG. 1 illustrates an internal structure of a combination lock (100) and contains, in this generally representative figure, three tumbler wheel assemblies (101, 102, 103), each tumbler wheel assembly preferably having the inventive micro-fingers of the change/set feature. In this exploded view, the internal structure of the tumblers cannot be seen, but conventional features of a combination lock are readily recognized. Shown are a hub (104) on which the tumbler wheel assemblies are mounted, conventional wheel flies (105*a*, 105*b*, 105*c*), spacer washers (106*a*, 106*b*, 106*c*), retaining ring (107), a drive cam (108) (having a drive cam gate (109)), a fence lever arm (110) (that includes a fence (111), nose (112), and pivot pin (113)), a spring washer (115) for tensioning the tumbler stack (116), and a lock bolt (117) for extending through the case (118) of the lock. By convention, the bottom tumbler wheel assembly (101) is considered the #1 wheel. Tumbler gates (120*a*, 120*b*, 120*c*-jointly or generally referenced by 120) are shown in the vertical, unlocked position. Also shown is a lock case lid (119) for the lock case and a conventional relocker trigger (121). Not shown is a drive shaft with a combination dial or a conventional spline key as is typically used to affix the drive cam to the drive shaft.

In this model, the nose (112) of the fence lever arm (110) is urged by a torsion spring wrapped around the lever arm pivot pin (113) to follow the circumference of the drive cam (108), but is restrained from engaging the drive cam gate (109) by the fence (111), which rides the circumferences of the tumbler wheel assemblies until all the tumbler gates (120) are aligned so that the fence (111) can drop in the space created by the aligned tumbler gates (120) and the lock can be opened.

FIG. 2A is a front view of the locking system with the lock case lid (119) removed. The lock bolt (117) is shown as extended in the locked position. The fence lever nose (112) can be seen in contact with the leading edge of the drive cam gate (109). Also shown in part are the tumbler gates (120), which are in alignment and in proximity to the fence (111) (hidden behind the fence lever arm (110)). The fence lever arm (110), upon engaging the drive cam gate (109), acts by mechanical linkage to translate counterclockwise rotational motion of the drive cam (108) with retraction of the lock bolt (117) in the slideway (114) (FIG. 2C).

Visible in FIG. 2A is an exemplary lug cam (124) that is used to disengage (spread) and engage the interlock mechanism (the interdigitating structure and interaction of the digitated micro-fingers (135) of at least one tumbler interlocking lever (132, 133) with the digitated micro-fingers (131') on the peripheral edge of a combination tumbler ring (131)). When the digitated micro-fingers (135) on the tumbler interlocking lever (132, 133) are disengaged from the digitated micro-fingers (131') on the outer peripheral edge of the combination tumbler ring (131), the combination can be changed. Rotating the change key (122) disengages the micro-fingers (135) from the micro-fingers (131'). Rotating the change key (122) to its original position reengages the micro-fingers of the tumbler interlocking lever (132, 133) with the interdigitating digitated micro-fingers (131') on the outer peripheral edge of the combination tumbler ring (131) to set the combination.

Figure 3:
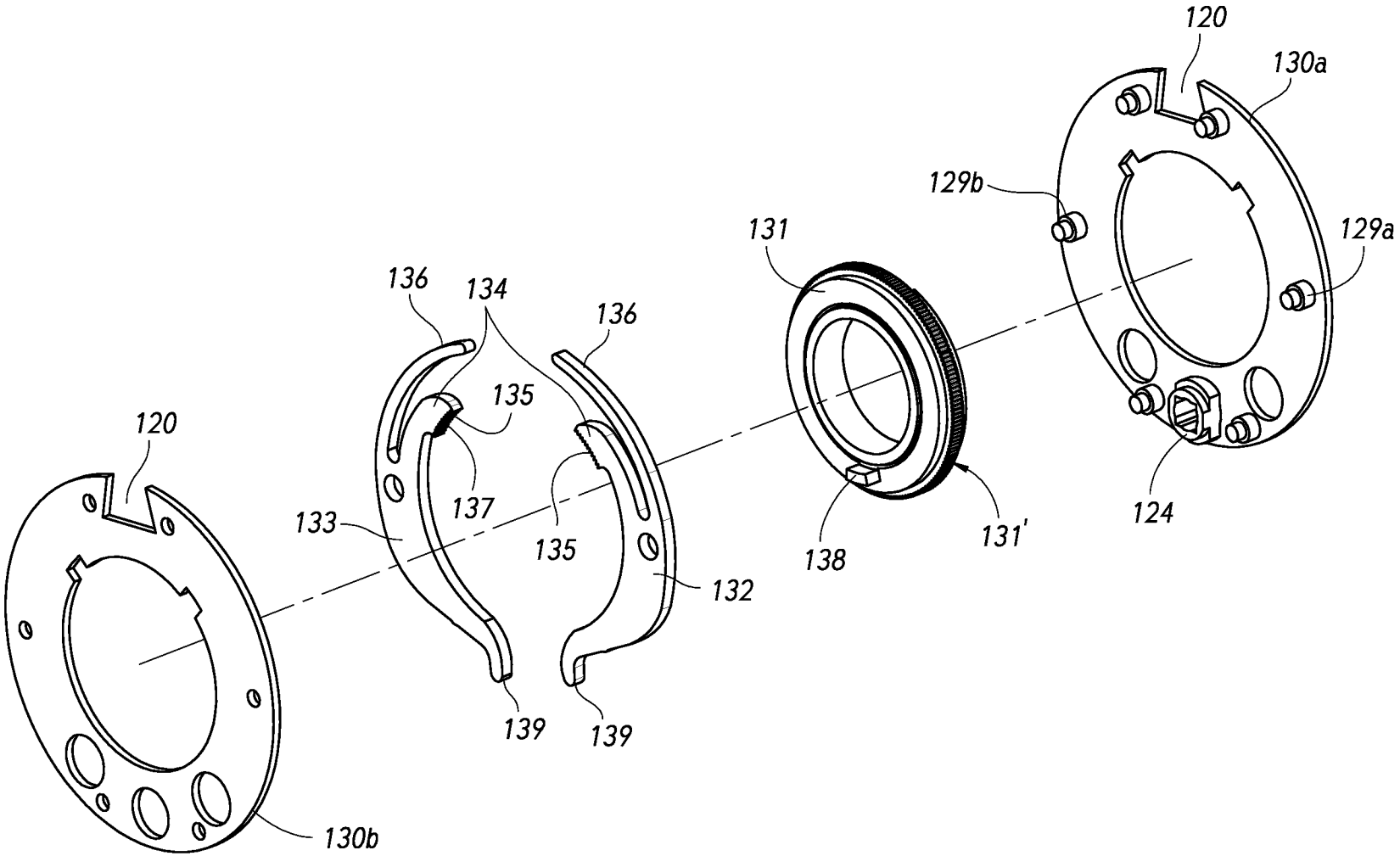
FIG. 3 is an exploded view of an exemplary first tumbler wheel assembly having a pair of outer gate rings sandwiching a combination tumbler ring with digitated micro-fingers along its peripheral edge as well as two locking lever arms with digitated micro-fingers.

FIG. 3 shows the structure of the tumbler wheel assemblies of the lock of FIG. 1 in more detail. In this exploded view, two paired outer gate rings (130*a*, 130*b*) are shown to sandwich an internal combination tumbler ring (131) with circumferentially disposed digitated micro-fingers (131') and a pair of interlock lever arms (132, 133). As shown, six rivets are used to seal the tumbler wheel assembly. Two of the rivets (129*a*, 129*b*) also serve as pivots for the interlock lever arms (132, 133). FIG. 3 also shows an exemplary drive pin (138) on the combination tumbler ring that is used for with engaging a wheel fly. As set forth in the background, this engagement is used to translate the motion of one tumbler wheel assembly with an adjacent tumbler wheel assembly.

As shown in FIGS. 3 and 4, each interlock lever arm (132, 133) is an arcuate, elongated, Y-shaped structure having a first upper branch (134) with modified digitated micro-fingers (135), a second upper branch spring tine (136), and a lower base end (139). The digitated micro-fingers (135) are palisaded on a generally arcuate face (137) of the first upper branch (134), the arcuate face (137) having a concave radius that matches the external radius of the combination tumbler ring (131). The spring tines (136) maintain the structure in constant tension so that the micro-fingers of the two gripping surfaces can be disengaged when the impinging surfaces of the lug cam (124) are relaxed.

Figure 4B:
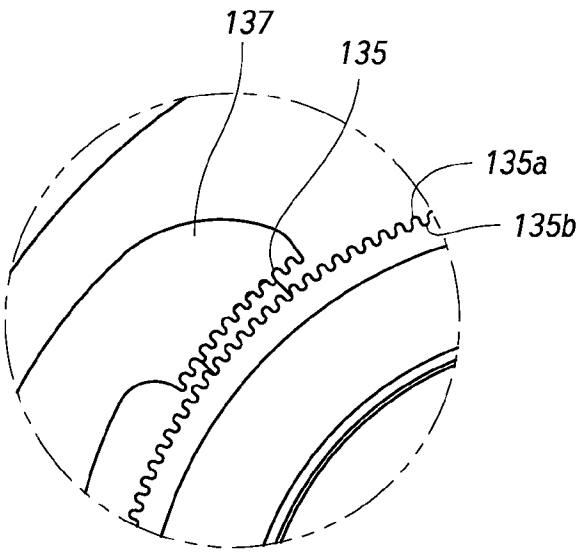
FIG. 4B is a detailed view of the digitated micro-fingers of the locking lever arms in relation to the digitated micro-fingers on the peripheral edge of the combination tumbler ring.
Figure 4A:
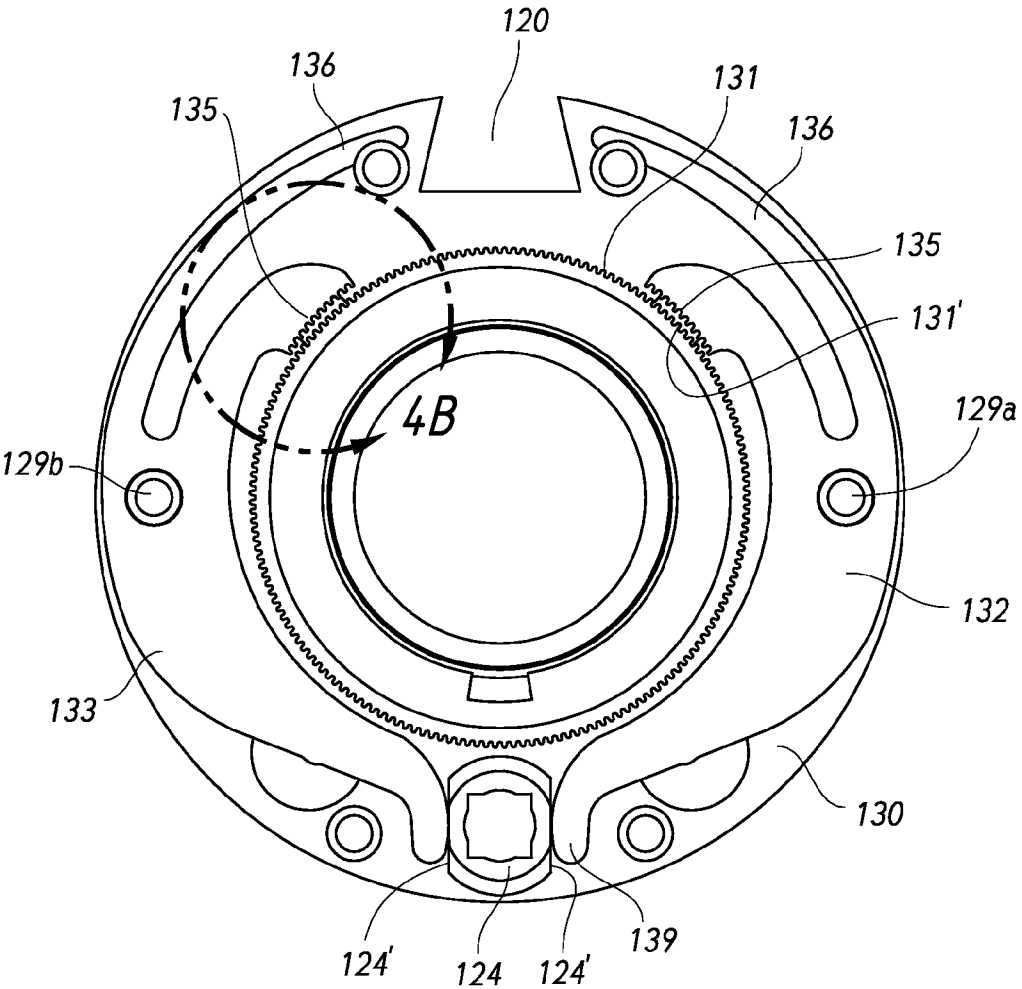
FIG. 4A is a front view of the assembled tumbler wheel assembly of FIG. 3 with the outer plate removed to show the locking lever arms in relation to the peripheral edge of the combination tumbler ring. The location of a detailed view of FIG. 4B is also shown.
Figure 4D:
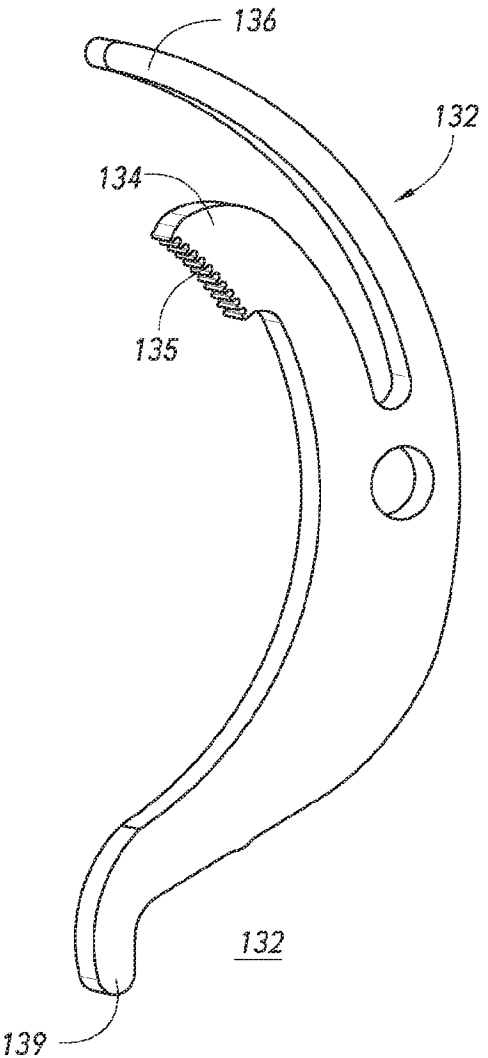
FIG. 4D is a perspective view of a locking lever arm.

FIG. 4A shows exemplary internal structure of the tumbler wheel assemblies. In this view, a pair of interlock lever arms (132, 133) is shown. The locking lever fingers (135) are disengaged in this view, but may be engaged with the fingers (131') of the combination tumbler ring (131). The two interlock arms of the pair normally operate with a pincer motion to grasp the combination tumbler ring. To change the combination, the locking lever fingers (135) of both interlock lever arms must be disengaged so that the combination tumbler ring can spin independently. Different combinations are obtained by rotating the combination tumbler ring with respect to the tumbler gate (120) of the paired gate rings (130*a*, 130*b*). To release the fingers, the lug cam (124) is rotated so that the flat surfaces (124') face the base ends (139) of the interlock lever arms and the structure relaxes. The spring tines (136) then exert sufficient restoring force to disengage the fingers. When the lug cam (124) is rotated so that the broader radii of the cam impinge on the base end (139) of the interlock lever arms (132, 133), the lever arms pivot, and the fingers (135) are pressed into the corresponding fingers (131') of the combination tumbler ring (131). The interlock lever arms (132, 133) have a pivot point and fulcrum formed by the center lateral rivets (129*a*, 129*b*), and the force of the lug cam (124) spreading the base ends (139) is compounded by the shorter length of the interlock lever arms (132, 133) above the fulcrum. Once locked, the cam-driven fit of the interdigitated fingers resists torsional motion of the combination tumbler ring and outer gate rings, thus fixing a mechanical "memory" of the combination number that opens that particular tumbler wheel assembly.

Figure 4C:
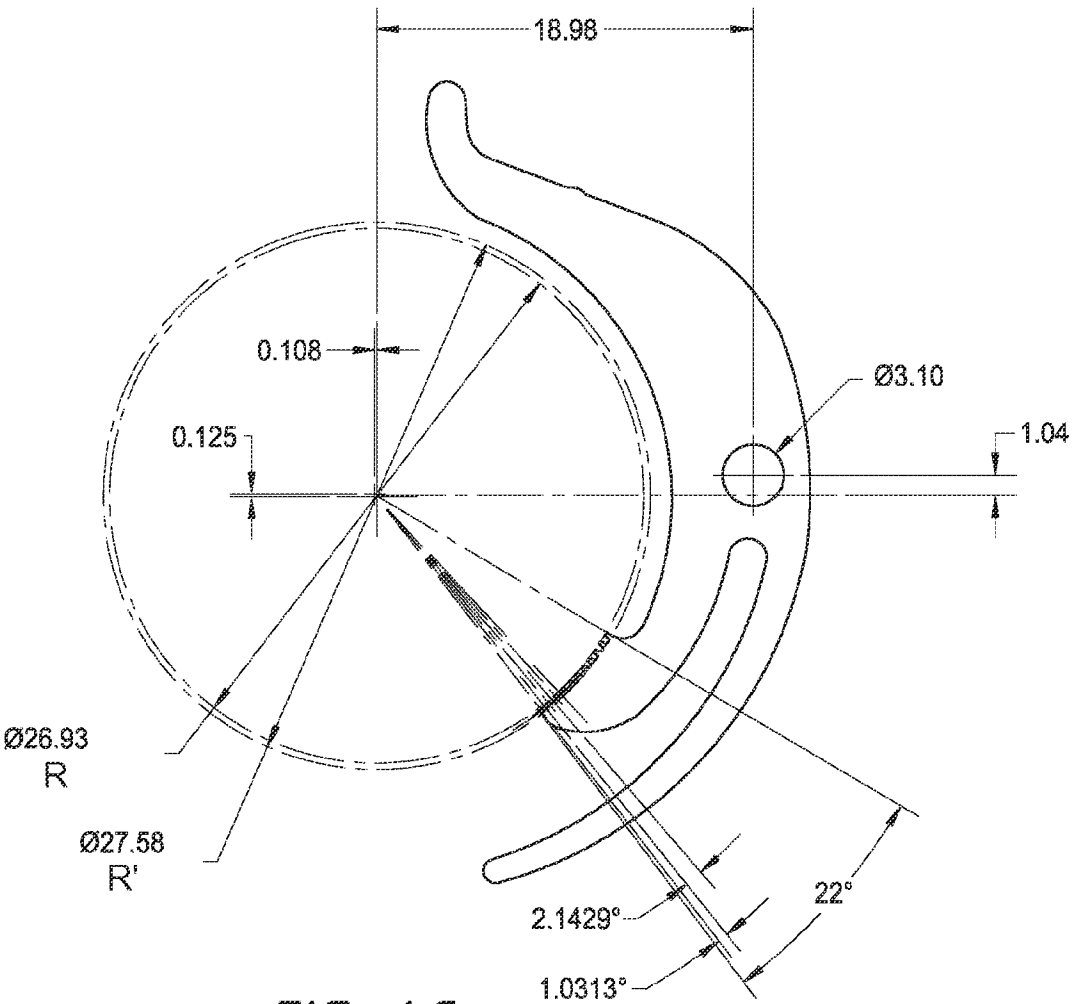
FIG. 4C is a mechanical drawing of a locking lever arm with digitated micro-fingers and illustrates a method for drawing the digitated micro-fingers.

FIGS. 4B and 4C show structural features of representative micro-fingers (135) in more detail. As illustrated, while not limited thereto, the interlock lever arms (132, 133) are shown to be formed with 11 fingers, which may be punched from hardened brass. (The fingers may be made, for example, from sheetstock of hardened brass or other material using precision punch equipment.) The micro-fingers (135) are aligned along arcuate concave faces (137) of the first upper branches (134). The arcuate concave faces (137) have an inside radius R that matches the outside radius R of the combination tumbler ring. In this instance, the combination tumbler ring has 168 fingers, each at about 2 degrees of arc. For a combination tumbler ring of about 2.5 cm in diameter, a combination may be dialed with an accuracy of less than one number on the dial face, eliminating the possibility of approximating the combination when dialing. The individual fingers (135), as illustrated have a height, from root to crown, of less than 1 mm, but cooperatively can resist more than 150 inch-pounds of torque applied to a combination tumbler ring in a jig holding the gate rings stationary. These micro-fingers (135), while diminutive in size, are thus resistant to slippage to a degree that would seem to defy their size, and have proven surprisingly resistant to wear, averaging a lifespan of about 15,000 full cycles and up to 75,000 full cycles when tested on an endurance dialing apparatus. The micro-fingers (135), in fact, were never observed to slip in this testing.

When the fingers of the locking lever arm and the fingers of the combination tumbler ring are fully interdigitated, the flats of adjacent tines are contactingly opposed and the crowns (135*a*) and roots (135*b*) are also contactingly opposed. This cooperative interdigitation with opposing flats generally perpendicular to the angular direction of torque was selected to increase torque resistance, and has proved experimentally to be superior to other commercial designs, even with face widths of less than a few millimeters and root to crown depth of the fingers of only a few millimeters or much less. In one realized embodiment, root to crown depth is 0.65 mm and torsional resistance meets or exceeds 150 inch-pounds. A thousandth of an inch may be shaved from the outer dimension of the fingers of the interlock lever arm to ensure the opposing crowns and roots readily interlock when the interlock lever arm pivots to engage the combination tumbler ring. Surprisingly, this configuration of cooperatively interdigitated fingers significantly multiplies torsional resistance and has demonstrated even more impressive improvements in endurance dialing tests, properties that would seem to belie the fragile nature of the individual fingers.

By using a commonly radiused crown (135*a*) (FIG. 4B) and root (135*b*) (FIG. 4B) for close apposition of the fingers (135) when engaged, grit and other residues are excluded from penetrating the tooth, which otherwise would lead to gradual build up and separation. The radius on the crowns and fillets of the fingers may preferably be semi-circular in plan view as shown, but may be semi-ovoid if desired. Although a degree of curvature at the crown and fillet is necessary for reliably interlocking the fingers, the faces between the fingers are flat and not beveled, sawtooth, undulating, or involute in profile. Generally, the faces (137) follow the projection of a radius line from the axial center of the wheel, the projection of which may be extended to map out the shape of the tooth on the interlock lever arms (132, 133), as shown in FIG. 4C, where the method for designing these micro-fingers to properly interdigitate can be better appreciated. Radius lines are drawn from the center of rotation of the tumbler and are projected through the arcuate concave member of the interlock lever arm. Each finger is formed to completely fill the root between adjacent fingers of the interlocking member and the flat faces are fully opposed in the interlocked position. In practice, a $1/1000^{th}$ inch clearance has proved useful. The clearance is preferentially subtracted from the outside dimensions of the pivoting fingers of the interlock lever arms (132, 133), which in their motion must describe an arc in order to settle into spaces between fingers of the combination tumbler ring, but may be instead subtracted from the dimensions of the fingers of the combination tumbler ring if desired. A flat face was chosen to improve the cooperative strength of the interlocking fingers.

The details of a method for forming an interlock arm with micro-fingers are generally the steps as follows:

a) designing a first micro-finger by drawing two concentric circles around a center, an inside circle with radius R and an outside circle with radius R', wherein the radius R is the desired radius of a combination tumbler ring, and the difference between R and R' is the desired height of the micro-finger;

b) intersecting the concentric circles with least two radial projections separated by an arc corresponding to the width of the desired micro-finger;

c) drawing a convex curvature on the crown of the micro-finger, the crown facing the center;

d) drawing a second micro-finger, wherein the first and second micro-fingers are joined at the root by a concave curvature mirroring the convex curvature of the crown;

e) continuing to draw micro-fingers around the full circumference; thereby forming a curve representing, in negative space between the micro-fingers, a full profile of a digitated combination tumbler ring circumference;

f) subtracting a clearance from the full profile and drawing outside the concentric circles but intersecting in an arc therewith, a lever shape of an interlock lever arm having an arcuate member with concave radius R', the arcuate member having a row of micro-fingers configured for interdigitatingly engaging the digitated combination tumbler ring circumference, the lever shape having a fulcrum configured thereon; and g) forming the interlock lever arm by a process of precision punching the lever shape from sheet stock, the lever shape having a row of micro-fingers arcuately disposed thereon.

The benefit in performance in resistance and durability achieved in this way is an advance in the art.

The combination tumbler ring may be made by casting or machining the micro-fingers of the combination tumbler ring formed in a punch. It should be noted that alternative construction methods and materials (known yet to be discovered) may be used to construct the combination tumbler ring and the micro-fingers thereon.

This inventive micro-fingered structure is illustrated with respect to pivotable interlock lever arms but also may be integrated into interlock pawls or other conventional gripping members known in the art (and referenced herein by incorporation) for changeably setting a combination of a combination lock.

Key Stabilization Feature:

A problem associated with changeable combination locks is removal or jiggling of the change key in the back of the lock case while the gate rings and associated combination tumbler rings are not fully interlocked. If this occurs, it would be possible to have a combination tumbler ring that could slip in its connection with the gate ring, effectively changing the combination. If the change key is loose, inadvertent slippage can occur resulting in a mis-set combination. Preventing a slip during removal or use of the change key can prevent or reduce the chances of an inadvertent lock out.

Figure 2D:
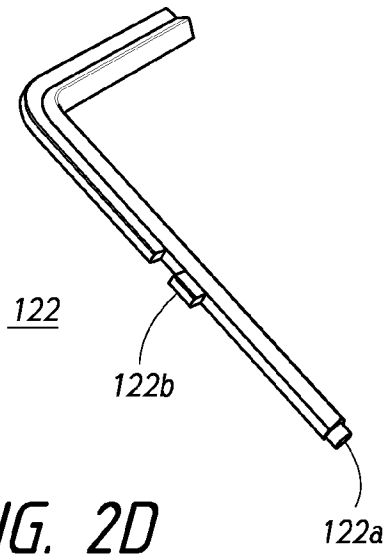
FIG. 2D is a perspective view of an exemplary change key for operating a combination change/set feature.

FIG. 2D shows a preferred change key (122) (FIG. 2D) that may be used to initiate the change of a combination of a lock. The change key (122), as shown, has an indexed insertion tip (122*a*) and a key flag (122*b*).

Figure 2B:
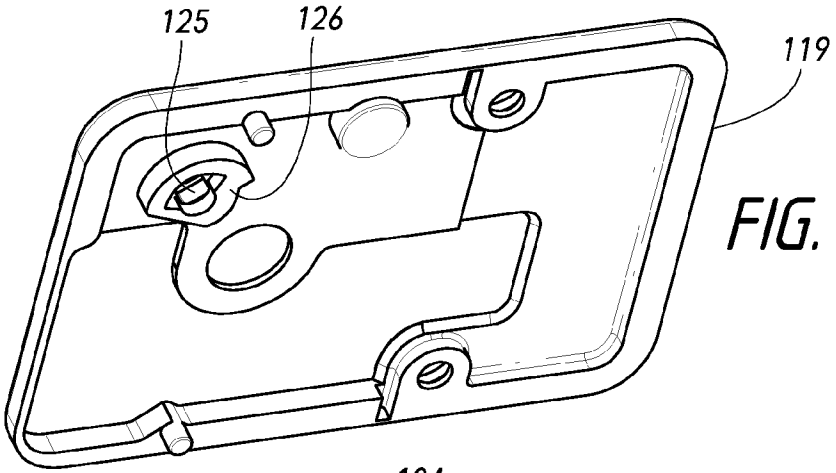
FIGS. 2B and 2C are perspective views of an exemplary lock case lid and an exemplary lock case of the combination lock of FIG. 1.
Figure 2C:
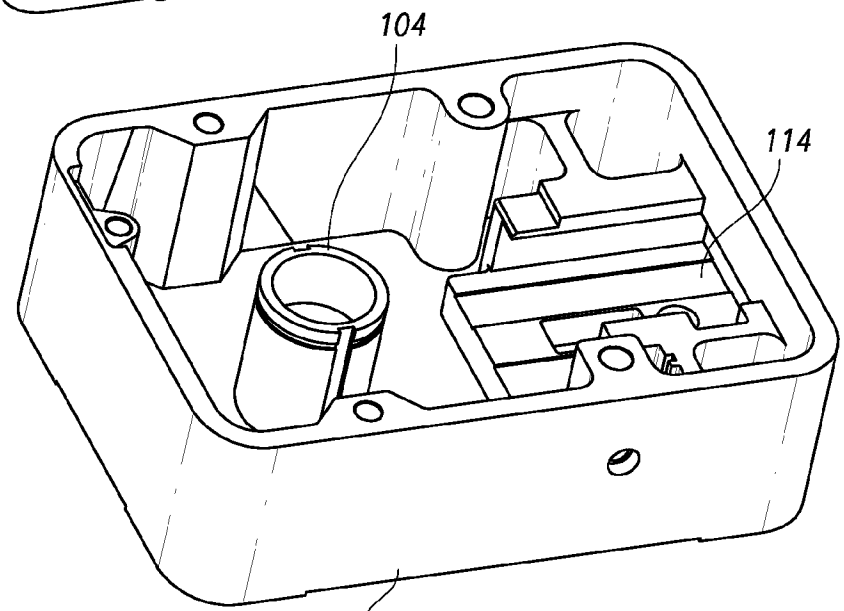

As shown in FIG. 2B (as well as FIGS. 15-18), surrounding the keyhole (125) is an internal boss (126) projecting from the internal surface of the case lid (119).

The key flag (122*b*) is constrained within the shaped keyhole (125) and the internal boss (126) so that the change key (122) is properly registered and so that rotation is restricted within the keyway (123).

The internal boss (126) is used to stabilize the change key (122) position during rotation. Working with the internal boss (126) is a pivot recess (125') in the base of the lock case (FIG. 1). The indexed insertion tip (122*a*) of the change key is received in the pivot recess (125') to aid in the stabilization of the change key during rotation. The boss (126) and pivot recess (125') together improve operation of the combination change key.

The boss may also be provided with a mated recess on the outside face of the lid. A coverplug may be inserted into the keyway when not in use.

Interchangeable Duress Feature:

The purpose of a duress feature is to actuate a generally silent alarm if a person is forced to open a safe. Using the duress feature, the person so encumbered is able to open the safe as demanded, but by dialing a special combination that differs from the standard combination (typically by adding ten to the first number in the combination), an alarm is triggered. In other words, the duress tumbler wheel permits the user to intentionally misdial the combination in a predetermined way and so that he can open the lock and sound an alarm. The alarm may be, for example, a silent alarm and/or a remotely monitored alarm. The only known "duress features" are not interchangeable and are limited to the tumbler wheel assembly in the #1 (bottom) position of a combination lock.

The improved duress feature allows customization of the position of the duress switch. Unlike the prior art in which the duress feature was only associated with the #1 position, the improved duress feature can be selected based on the wants and needs of the user. In most situations a user will select a locking system that will come preset with the duress feature in a random position and may never change it. Resellers and sophisticated users could, however, customize the position repeatedly. Theoretically, the improved duress feature could be set to function in the #2 position one week, in the #3 position the next week, and the #1 position the week after that. For users who wish to customize the position of the duress switch, there is no option currently available.

Figure 5:
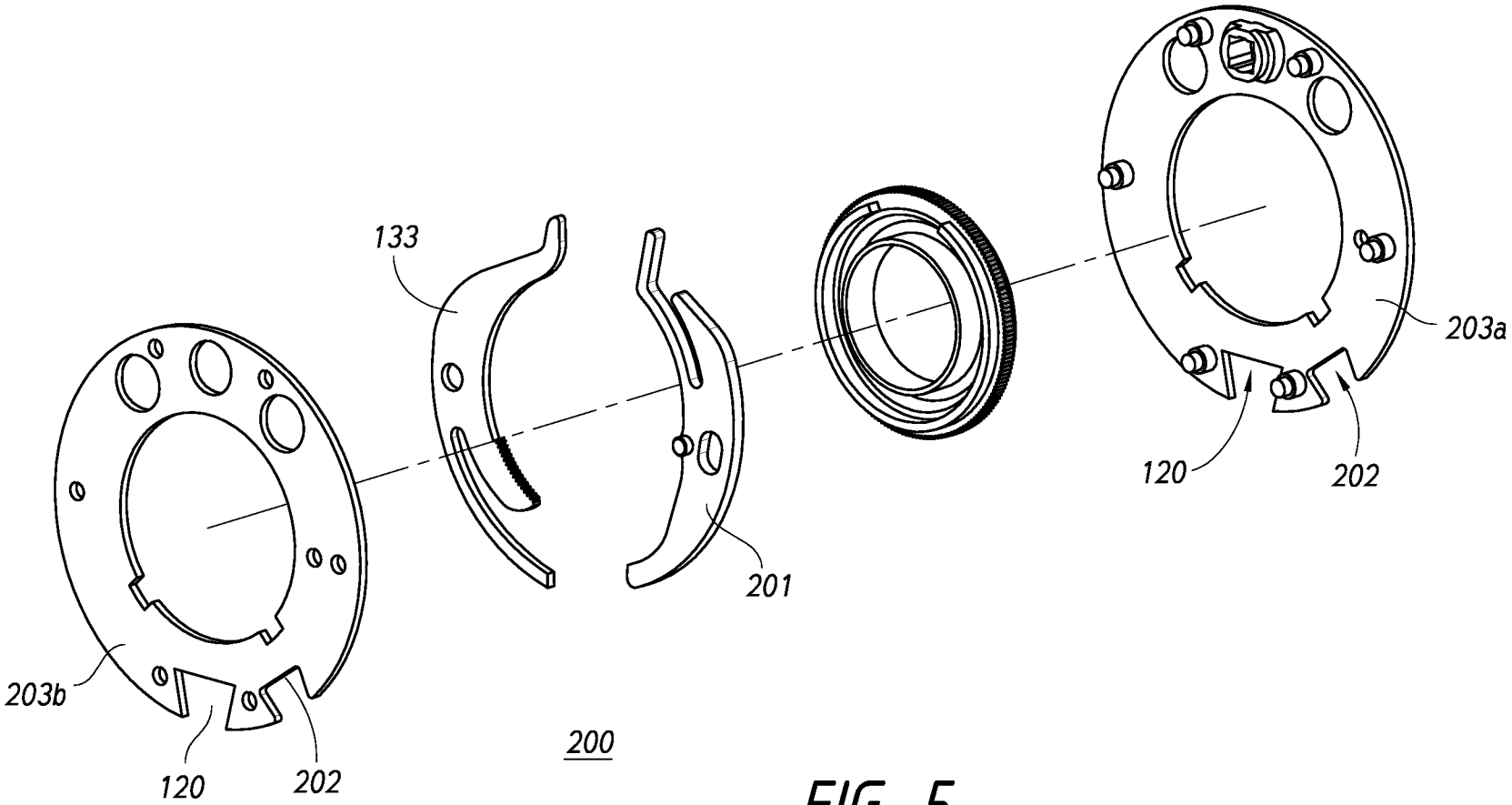
FIG. 5 is an exploded view of an exemplary second tumbler wheel assembly having a pair of outer gate rings (each with an exemplary duress gate defined therein), the outer gate rings sandwiching a combination tumbler ring, a locking lever arm, and an exemplary duress lever arm.

An improved duress feature preferably uses a modified tumbler wheel assembly (200) (referred to as a "duress tumbler wheel assembly" and shown in FIGS. 5-7) and a duress switch (220) (e.g. a microswitch such as that shown in FIGS. 7-8) to trigger the alarm. The duress tumbler wheel assembly (200) preferably includes a special duress lever (201) and a special duress gate (202). A lock having the duress feature would substitute a duress tumbler wheel assembly (200) for one of the tumbler wheel assemblies (101, 102, 103).

Comparing FIG. 5 with FIG. 3, it is apparent that the duress tumbler wheel assembly (200) is similar in construction to the standard tumbler wheel assemblies (e.g. those shown in detail in FIGS. 3 and 4). In a duress tumbler wheel assembly (200), however, one of the interlock lever arms (132, 133) is replaced by a duress lever (201) and the two paired outer gate rings (203*a*, 203*b*) each have a special duress gate (202) positioned at a predetermined distance from their respective tumbler gates (120). The duress lever (201) functions in cooperation with the special duress gates (202) to trigger an associated duress switch (220). The duress tumbler wheel assembly (200) functions similarly to the tumbler wheel assemblies (101, 102, 103) (FIGS. 3 and 4) and may be substituted for any of the tumblers of the stack (116) shown in FIG. 1.

Figure 6B:
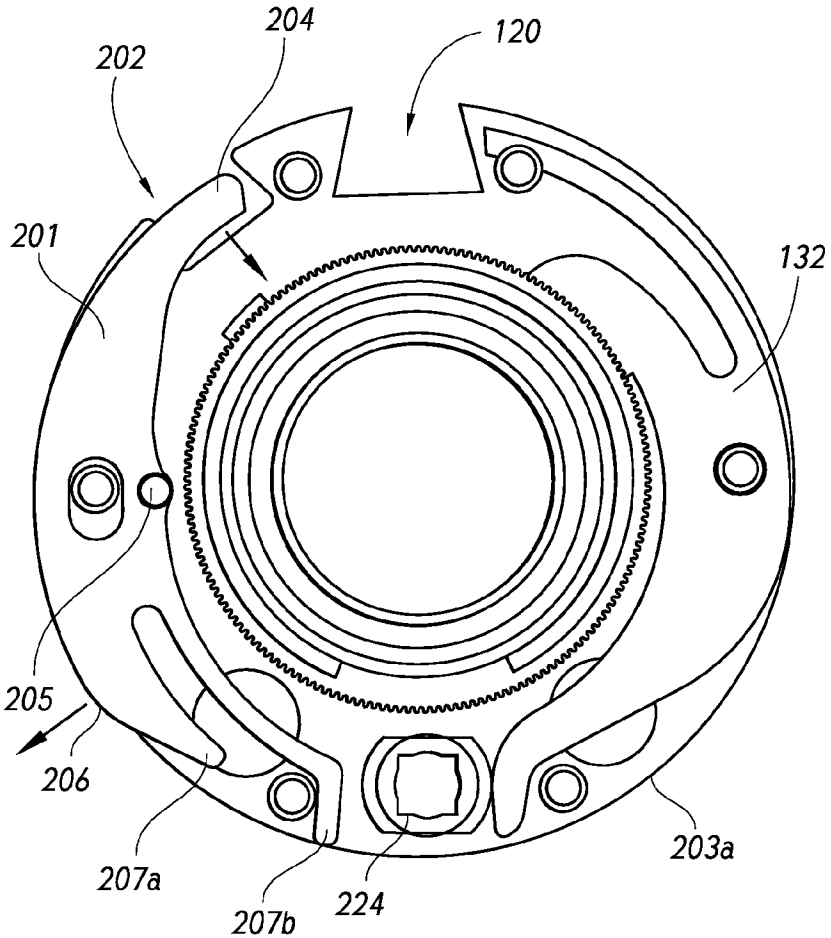
FIG. 6B is a front view of the tumbler wheel assembly of FIG. 5 with the outer plate removed to show the interaction of the locking lever arms with the microswitch assembly. In this view, the duress lever arm is in an alarm position with a protruding cam shoulder.
Figure 6A:
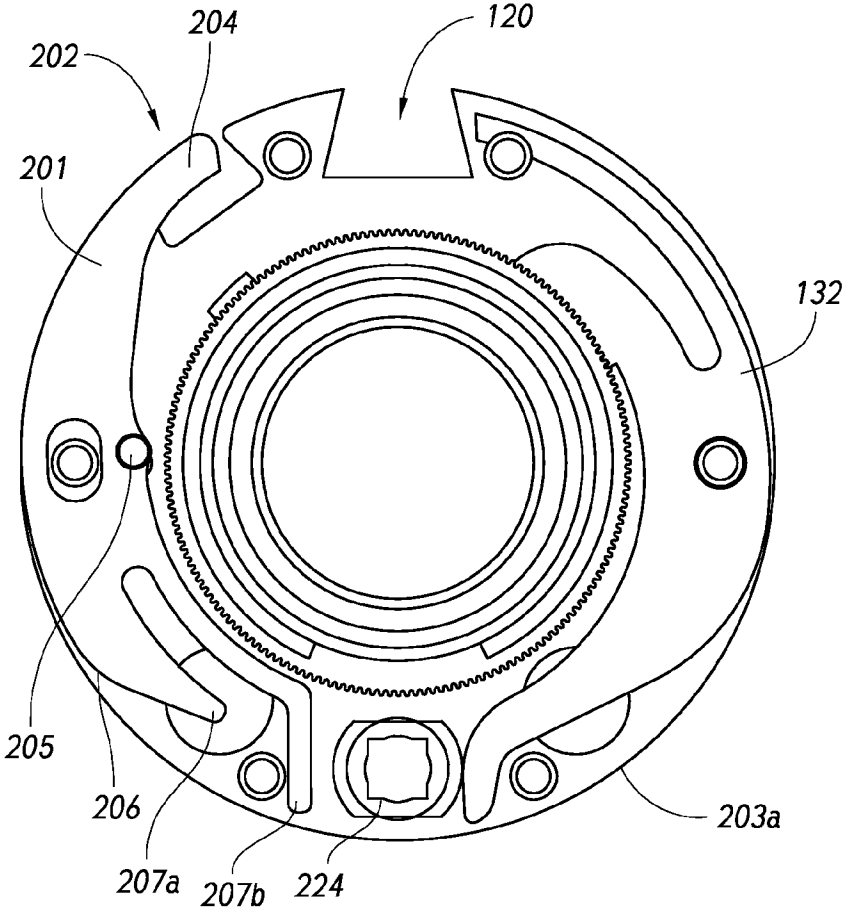
FIG. 6A is a front view of the tumbler wheel assembly of FIG. 5 with the outer plate removed to show the duress lever arm with a microswitch assembly. In this view, a duress lever arm is shown in the resting position.

FIGS. 6A and 6B are plan views of a duress tumbler wheel assembly (200) with an outer gate ring (130*b*) removed. The duress wheel has two gates, the conventional tumbler gate (120) and a special duress gate (202). In FIG. 6A, the duress gate (202) is occluded (closed off) by a blocking arm (204) of the duress lever (201), a position that corresponds to an armed but inactive condition. The duress lever (201) pivots on pivot (205) to an "alarm active" position depicted in FIG. 6B. What triggers the pivot of the duress lever (201) is the force of the fence (111) dropping into the duress gate (202) and depressing the blocking arm (204). In the alarm active position, a shoulder (206) of the duress lever (201) projects outside the circumference of the duress tumbler wheel assembly (200) and is in a position, when rotated to open the lock, to close a duress switch (220).

Figure 6C:
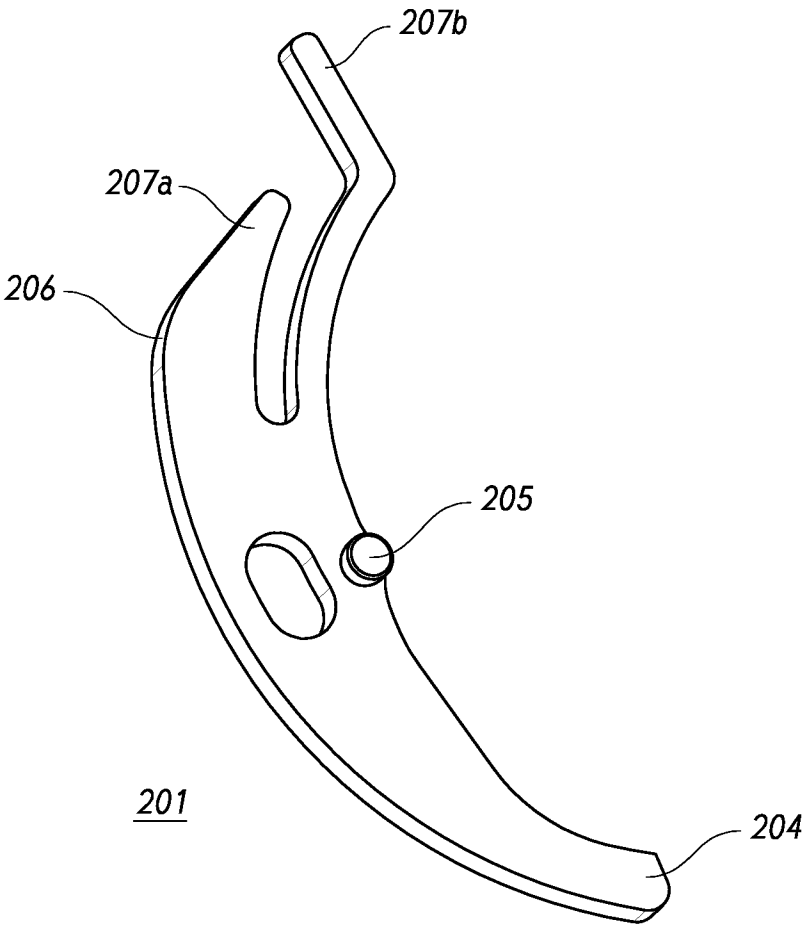
FIG. 6C shows a perspective view of the exemplary duress lever arm.

FIG. 6C shows the exemplary preferred duress lever (201) as an arcuate, elongated, Y-shaped structure having a first upper branch (207*a*) with a shoulder (206), a second upper branch spring tine (207*b*), and a lower base blocking arm (204). The upper branches (207*a*, 207*b*) are also referred to as the "first end" and the lower base (204) is also referred to as the "second end." The spring tine (207*b*) is a resilient member capable of exerting sufficient restoring force to relax the shoulder (206) if the dial is turned without disengaging the lock bolt. In other words, even if the duress feature is activated, if the lock is not opened (the lock bolt (117) is not retracted), the user can prevent the alarm from sounding if the duress situation has passed by continuing to turn the dial. As long as the lock bolt (117) is not retracted, the alarm will not sound. This "second chance" feature is unique and invaluable if a mistake has been made, the duress situation has been handled, and/or additional facts are determined that make sounding an alarm too dangerous. The spring tine (207*b*) forces the duress lever (201) back to an "alarm not active" position depicted in FIG. 6A. This "reset" feature is unique and permits even the most unsophisticated user to continue using the locking system without interruption.

Figure 7A:
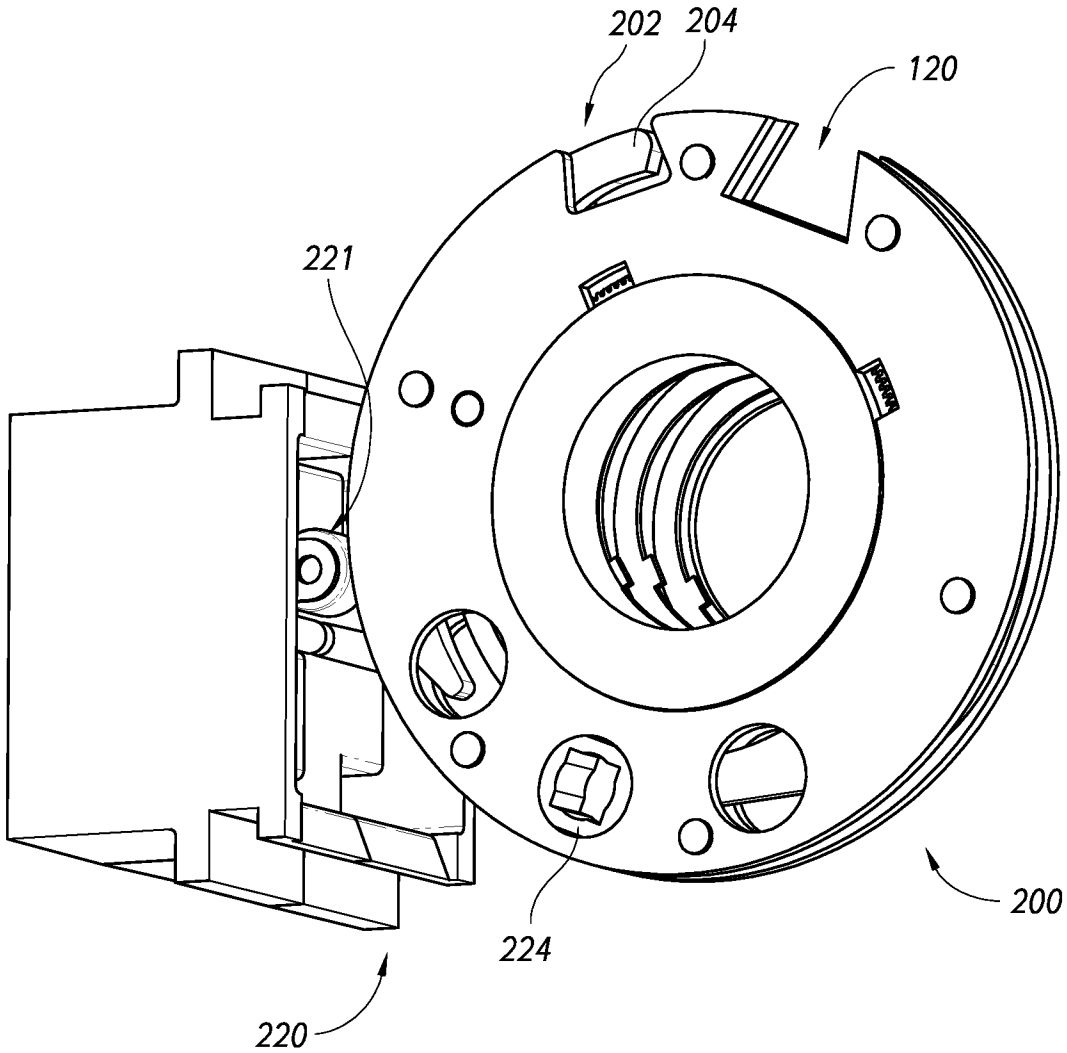
FIGS. 7A and 7B are perspective views showing the interaction of a duress lever arm with a microswitch assembly.
Figure 7B:
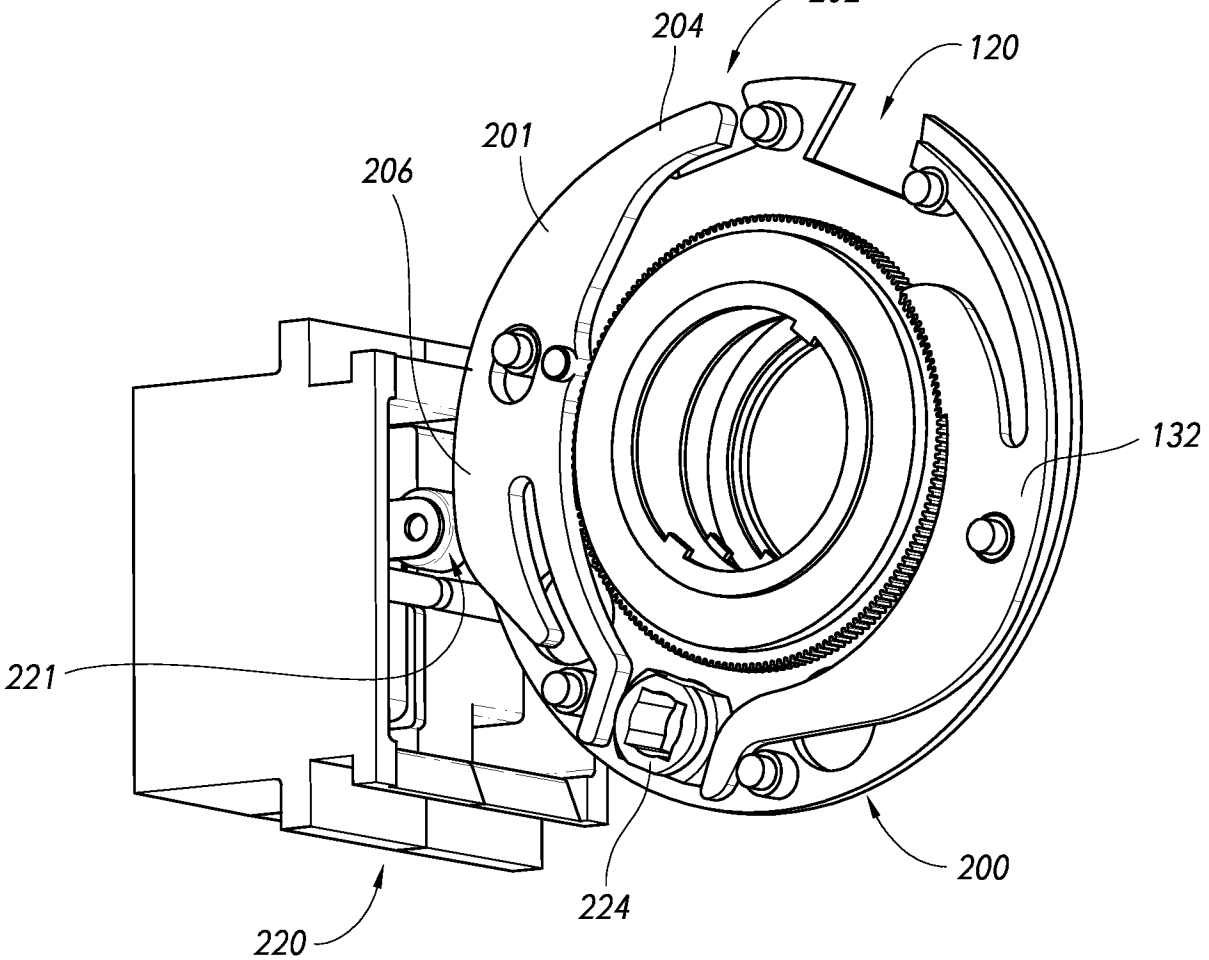

FIGS. 7A and 7B show the interaction of a duress tumbler wheel assembly (200) with a duress switch (220) (shown as a microswitch assembly). In FIG. 7A, a rollerswitch (221) of the microswitch is seen to be positioned with a predetermined clearance from the peripheral edge of the duress tumbler wheel assembly (200). In FIG. 7B, the outer gate ring has been removed so that the protruding cam shoulder (206) is seen to impinge on the rollerswitch (221), thus actuating a relay and sending a silent alarm.

Figure 8B:
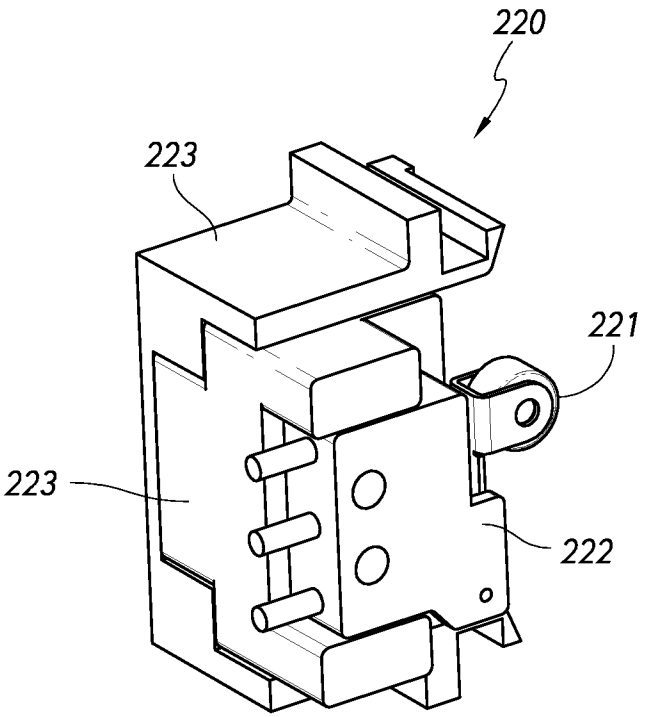
FIGS. 8A and 8B are perspective views of a microswitch assembly with interchangeable spacers for adjusting the position of the microswitch relative to the stack of tumbler wheel assemblies.
Figure 8A:
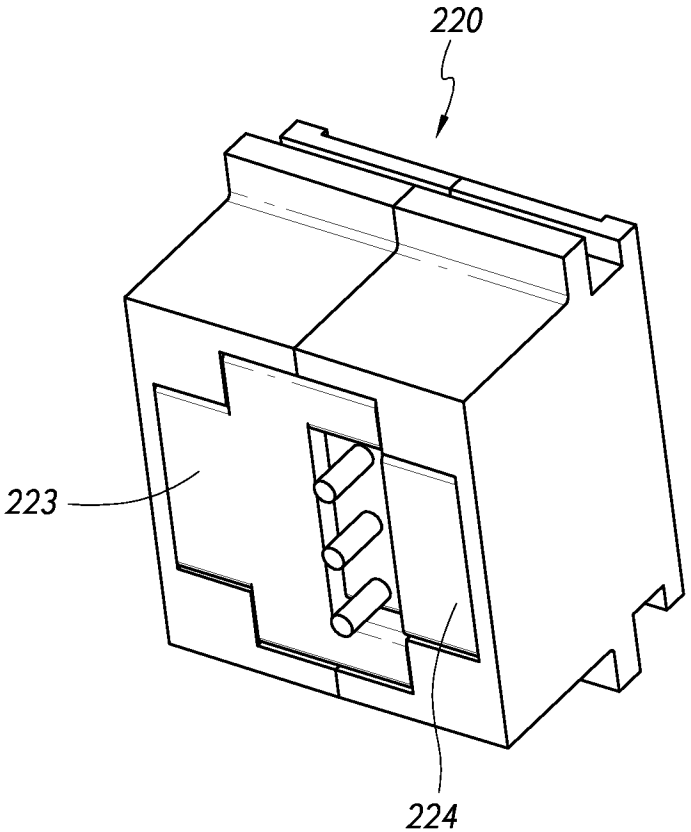

FIGS. 8A and 8B are perspective views of the microswitch assembly (220). As shown in FIG. 8B, the microswitch assembly consists of interchangeable blocks that can be repositioned so the rollerswitch and associated microswitch module (222), having three leads for wiring the alarm) can interact with a duress tumbler in the #1 position, #2 position, or #3 position. Using a combination of spacer blocks (223, 224) as shown, the microswitch module can be interchangeably assembled at any of three positions corresponding to the position of the duress tumbler chosen by the user.

Figure 8E:
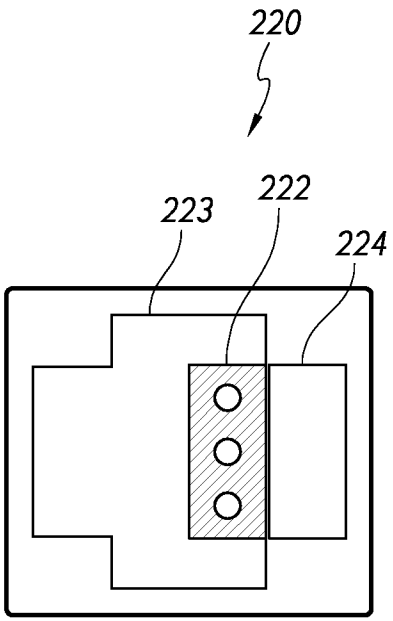
FIGS. 8C through 8E are schematic representations of the use of interchangeable spacers to reposition the microswitch.
Figure 8D:
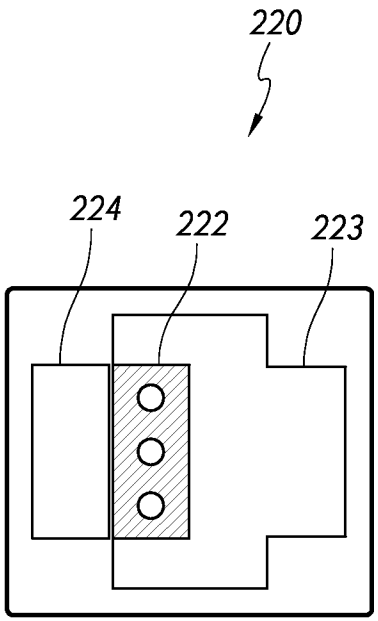
Figure 8C:
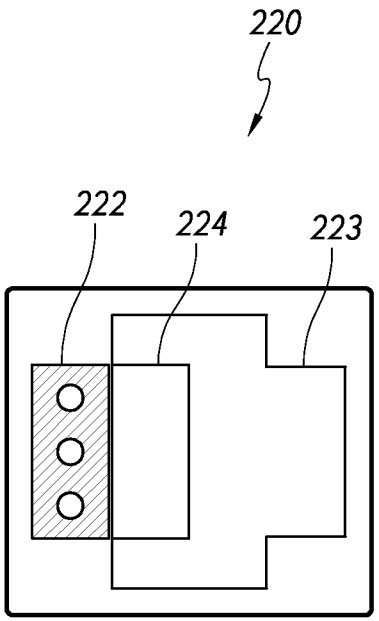

FIGS. 8C through 8E schematically depict three rearrangements of the modular construction of spacer blocks and relay component. The fourth rearrangement is similar to FIG. 8E, but the spacer block 224 exchanges position with the microswitch module (222).

Several components of the microswitch assembly (220) and the duress lever (201) are made from very flexible material such as a nylon material with about 15% glass. These may be made simultaneously in the same process.

While the interchangeable duress feature may be used in combination with the interlock mechanism (including at least one tumbler interlocking lever (132, 133) with digitated micro-fingers (135) and at least one combination tumbler ring (131) with digitated micro-fingers (131') on its peripheral edge) of the invention as shown in FIGS. 5 and 6, the duress feature may also be used in conventional combination locks. The benefit in flexibility achieved in this way is an advance in the art.

Fence Control Feature:

Preferred locking systems include a fence control feature that provides crime prevention in that it helps stop the "cracking" of a combination lock by skillful manipulation because it provides for "subtle" operation of the combination lock without obvious signs that reveal the combination to a skilled touch. Control of the fence is important in defeating lock manipulation, where a skilled safecracker can determine the position of the gate(s) by sensing subtle perturbations in the motion of the dial as the lock is cycled.

Figure 9:
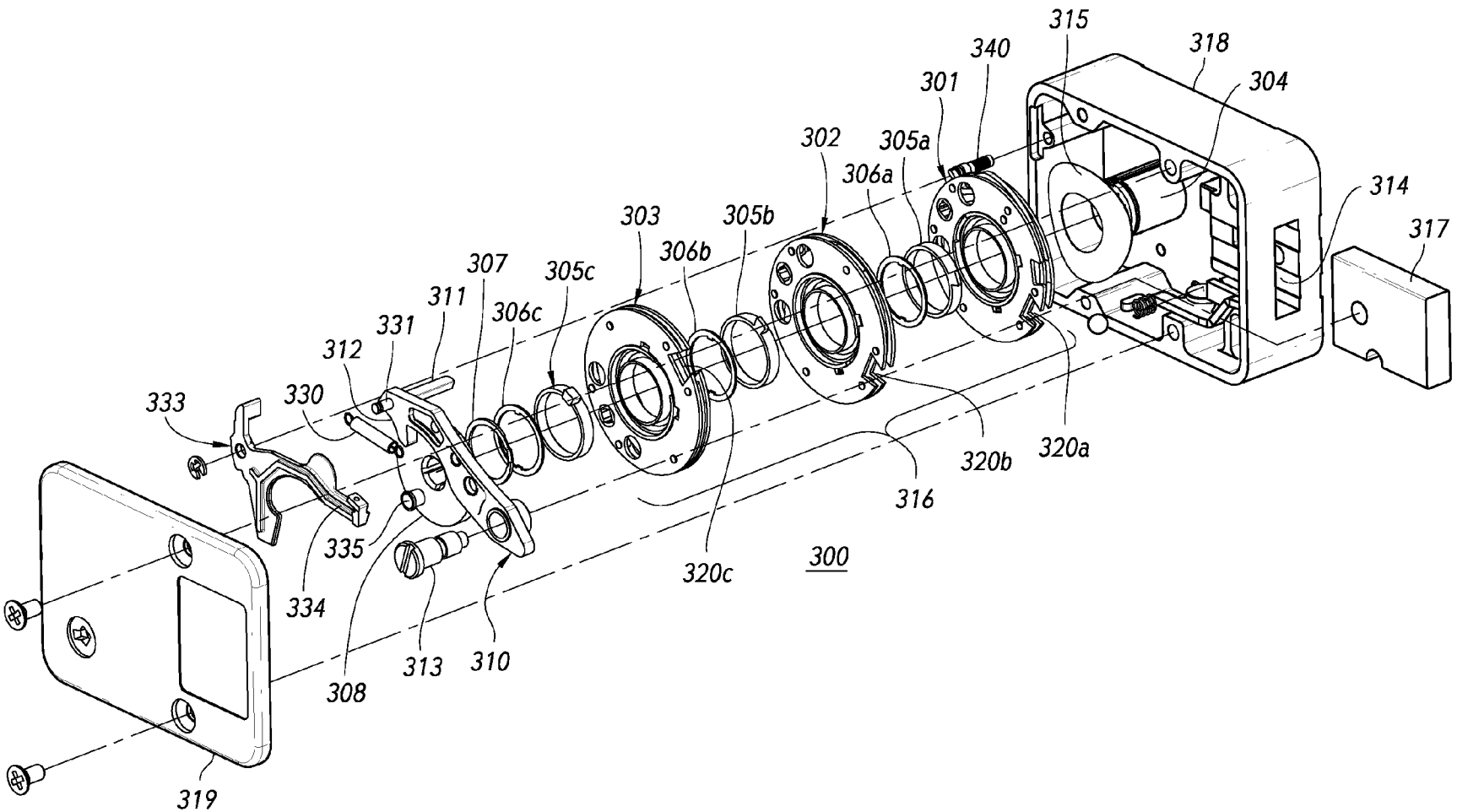
FIG. 9 is an exploded view of an exemplary combination lock with three tumbler wheel assemblies and a trigger plate for suppressing lever nose and fence contact before the tumblers are aligned.

Turning to FIG. 9, a combination lock (300) with a fence control feature is shown in exploded view. The combination lock of this generally representative figure includes three tumbler wheel assemblies (301, 302, 303), each tumbler wheel assembly having the inventive integral micro-fingers of the change/set feature depicted in FIGS. 3 and 4A-4D. Also shown are a hub (304) on which the tumbler wheel assemblies are mounted, conventional flies (305*a*, 305*b*, 305*c*), spacer washers (306*a*, 306*b*, 306*c*), retaining ring (307), a drive cam (308) (with drive cam gate (309) not visible), a fence lever arm (310) (having a fence (311), nose (312), and pivot pin (313)), a spring washer (315) for tensioning the tumbler stack (316), and a lock bolt (317) for extending through the case (318) of the lock. By convention, the bottom tumbler wheel assembly (301) is considered the #1 wheel. Tumbler gates (320*a*, 320*b*, 320*c*) are shown in a scrambled, locked position. Also shown is a lid (319) for the case. Not shown is a conventional relocker trigger and a drive shaft with combination dial or a conventional spline key as is typically used to affix the drive cam to the drive shaft.

In this apparatus, an overcenter spring (330) is stretched from a pin (331) affixed in contraposition to fence (311) on the fence lever arm (310) to a specially modified bracket (334) at the tip of what is herein termed a "trigger plate" (333), so-named for its hair trigger action. Also shown is an excentric (having the normally central portion not in the true center) trigger pin (335) affixed to the drive cam.

Figure 10A:
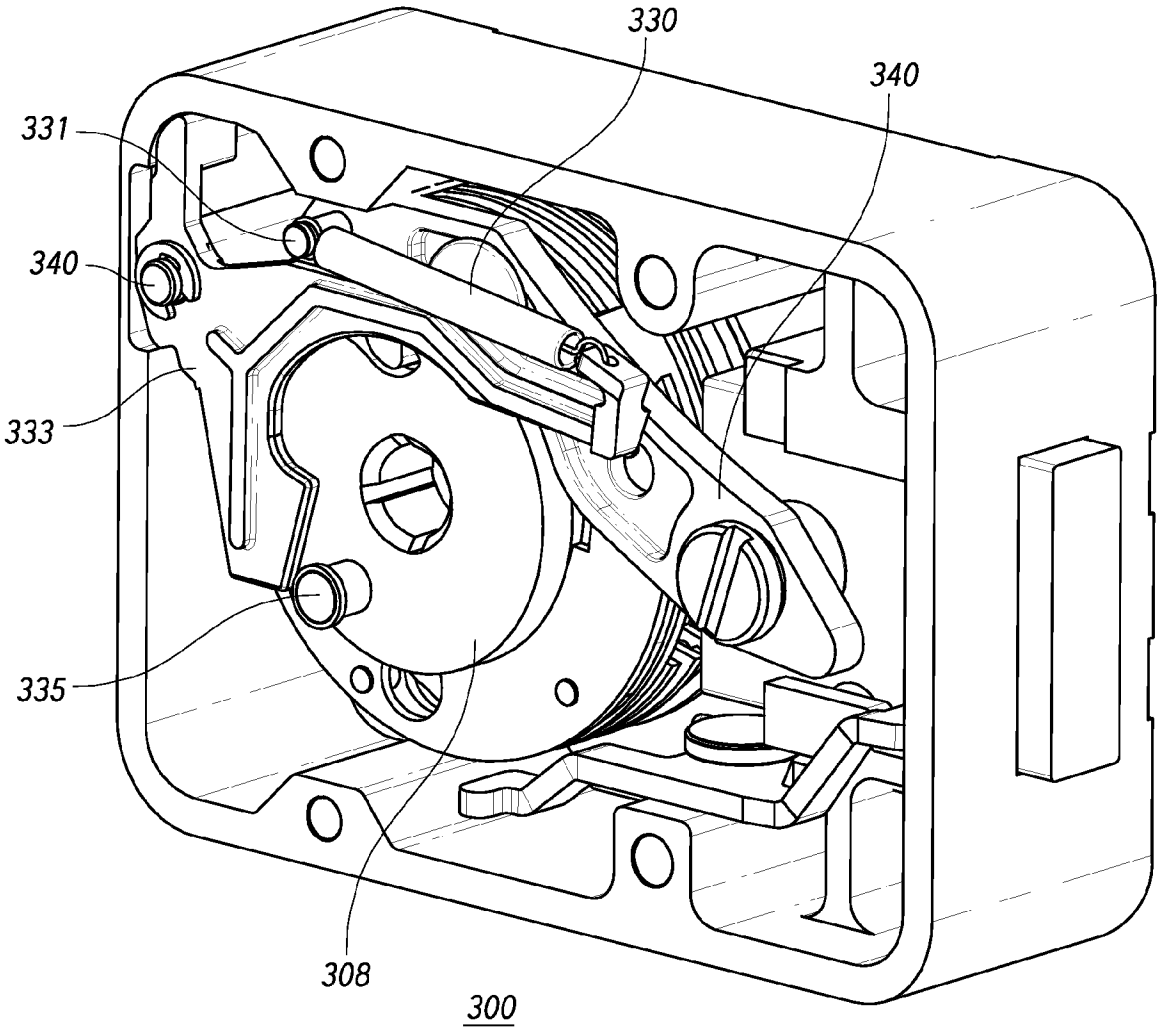
FIG. 10A is a perspective front view of the combination lock of FIG. 9.

The structure of the preferred fence control feature (fence control mechanism) is depicted in perspective view as a fully assembled lock in FIG. 10A. Trigger plate (333) is shown partially occluding the drive cam and contacting trigger pin (335). Spring (330) is seen to connect the nose end of the fence lever arm (312) and the spring attachment bracket (334).

Figure 10B:
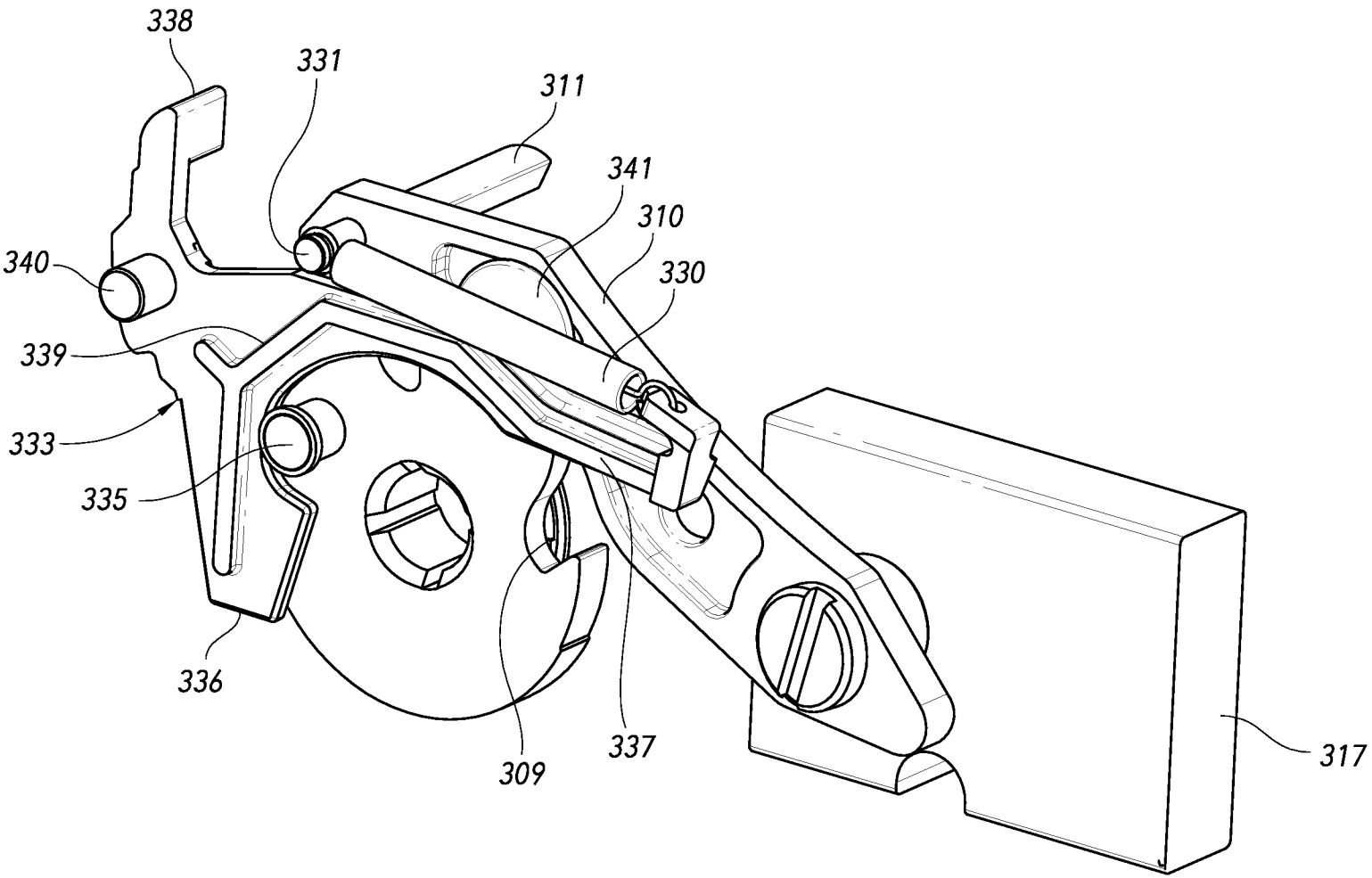
FIG. 10B is a perspective view showing the mechanical linkage between a lock bolt, lever arm, drive cam, and trigger plate with an overcenter spring.

The mechanical linkage is shown in more detail in FIG. 10B. Here the parts of the structure of the preferred fence control feature that drive the bolt (317) are isolated from the tumbler wheel assemblies and case. Shown are the trigger plate (333), the fence lever arm (310) (with fence (311), and spring attachment pin (331)), the drive cam wheel (308) with spring pin (331), and the overcenter spring (330). The trigger plate is shown with a depending cam follower arm (336), an overcenter arm (337), and a stop arm (338). An articulated rib (339) reinforces the trigger plate, which is made of fiber composite nylon with 30% glass. The trigger plate is seen to pivot at a trigger plate fulcrum (340) mounted on the lock case. The trigger plate is also modified with an apron or skirt (341) that is designed to prevent the nose of the lever arm from catching on the trigger plate.

The coordinated action of the overcenter spring and trigger plate arms are shown in FIGS. 11A-11D. The dotted line drawn down the center of the fence lever arm (310) is shown for reference so the transition of the overcenter spring (330) from a first position above the reference line to a second position below the reference line, and back, can be readily followed.

Figure 11A:
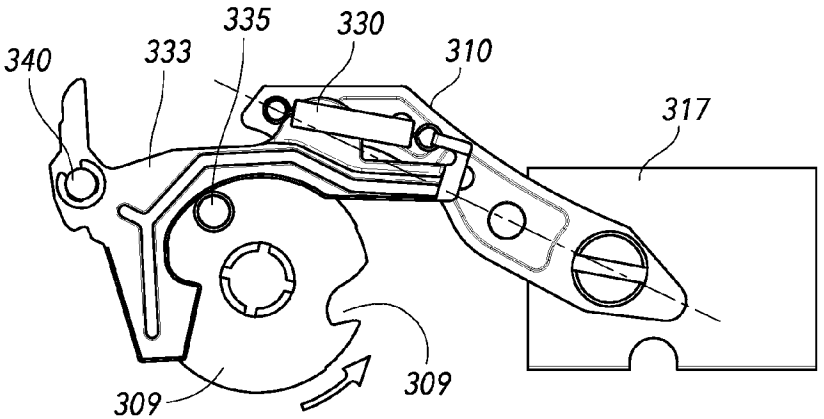
FIGS. 11A through 11D are front views of the mechanical linkage together showing a progression of movements as the lock linkage is cycled from a bolt-extended position to a bolt-retracted position.

In FIG. 11A, the fence (311) is raised above the drive cam and tumbler wheel assemblies and the drive cam gate (309) is revolving in a counterclockwise direction toward the nose, which is shielded behind skirt (341). Overcenter spring (330) is in a first position, biasing the fence (311) and nose (312) away from the wheels. The cam follower arm of the trigger plate is riding on the excentric trigger pin (335) but is minimally displaced thereby.

Figure 11B:
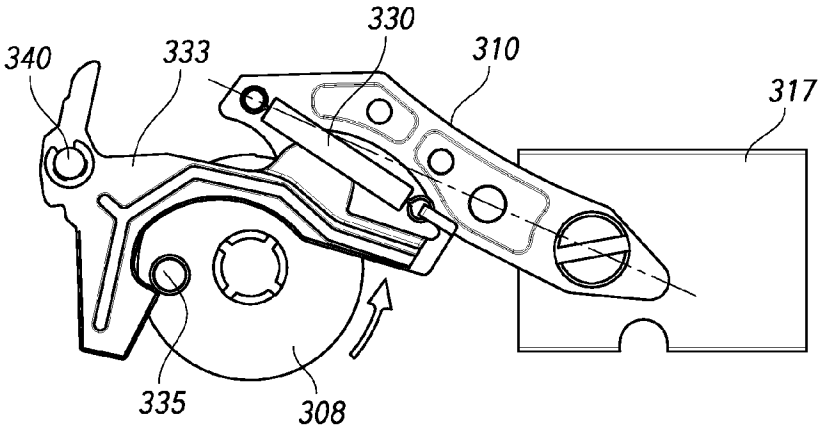
Figure 11C:
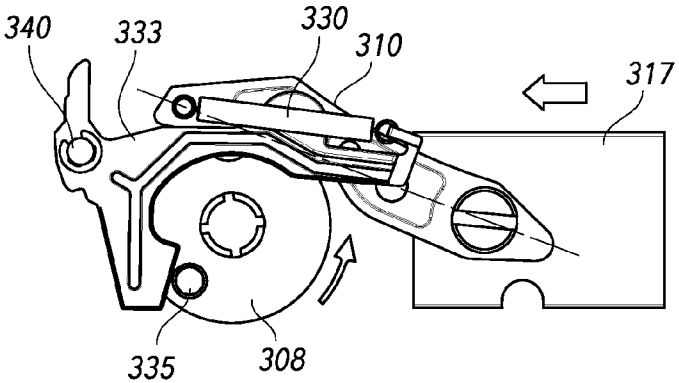

In FIG. 11B, the cam follower arm is sharply driven downward by the trigger pin, driving the overcenter spring to its second position, which in turn pulls the fence (311) into proximity with the tumbler wheel assemblies. This transition occurs very sharply, within a degree or two of rotational arc, and precisely matches the rotational position of the drive cam gate required for engaging the nose—if the tumbler gates are correctly aligned. Contrastingly, if the tumbler gates are not aligned, the drive cam gate does not engage the nose and on continued rotation, again in a sharp vertical motion, the spring propels the lever arm back to the inactive first position, as shown in FIG. 11C.

Figure 11D:
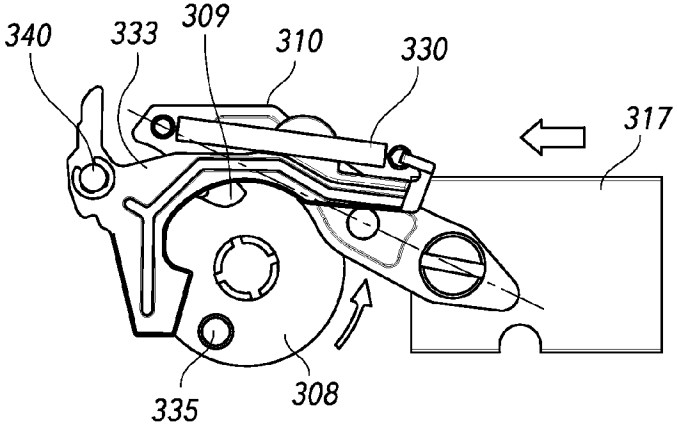

FIG. 11D depicts the outcome when the tumbler gates are correctly aligned and the lever nose engages the drive cam gate. Continued counterclockwise rotation of the drive cam pulls the lever arm with it and retracts the lock bolt. Upon release of the drive mechanism after the lock is open, the spring will return to a relaxed position, drawing the fence lever arm (310) up to the first position.

The drop-in point of the lever arm nose is at number 98 and the fence contacts the peripheral edge of the gate wheels from number 95 to about number 4. This and the spring constant of the overcenter spring precisely controls/limits lever drop motion to a very narrow contact window and reduces lever pressure such that one is not able to feel and/or note any difference in the fence contact. This 95~4 zone is the exact position in which the lever nose is pulled down during normal operation. The spring constant of the overcenter spring depicted in FIG. 12 is 1.08 lb/inch.

When the trigger arm is dimensioned as shown, and using an LE014A04M extension spring supplied by Lee Springs (Brooklyn, N.Y.), or an equivalent thereof, the transition from the first position to the second position is very sharp and the spring is compliant throughout the range of motion required. This music wire, zinc plated spring was chosen after extensive testing, and has a free length of 0.75 inches, 39 coils, a wire diameter of 0.014 inches, and a rate of 1.08 lbs/inch. Advantageously, the spring operates within an acceptable fatigue range, as evidenced by endurance autodial testing, where between 15,000 and 75,000 cycles were obtained without deterioration in performance or degradation of the cam follower arm (336). Surprisingly, a plastic part formed as described here was found to have superior wear resistance to a metal part!

Figure 12A:
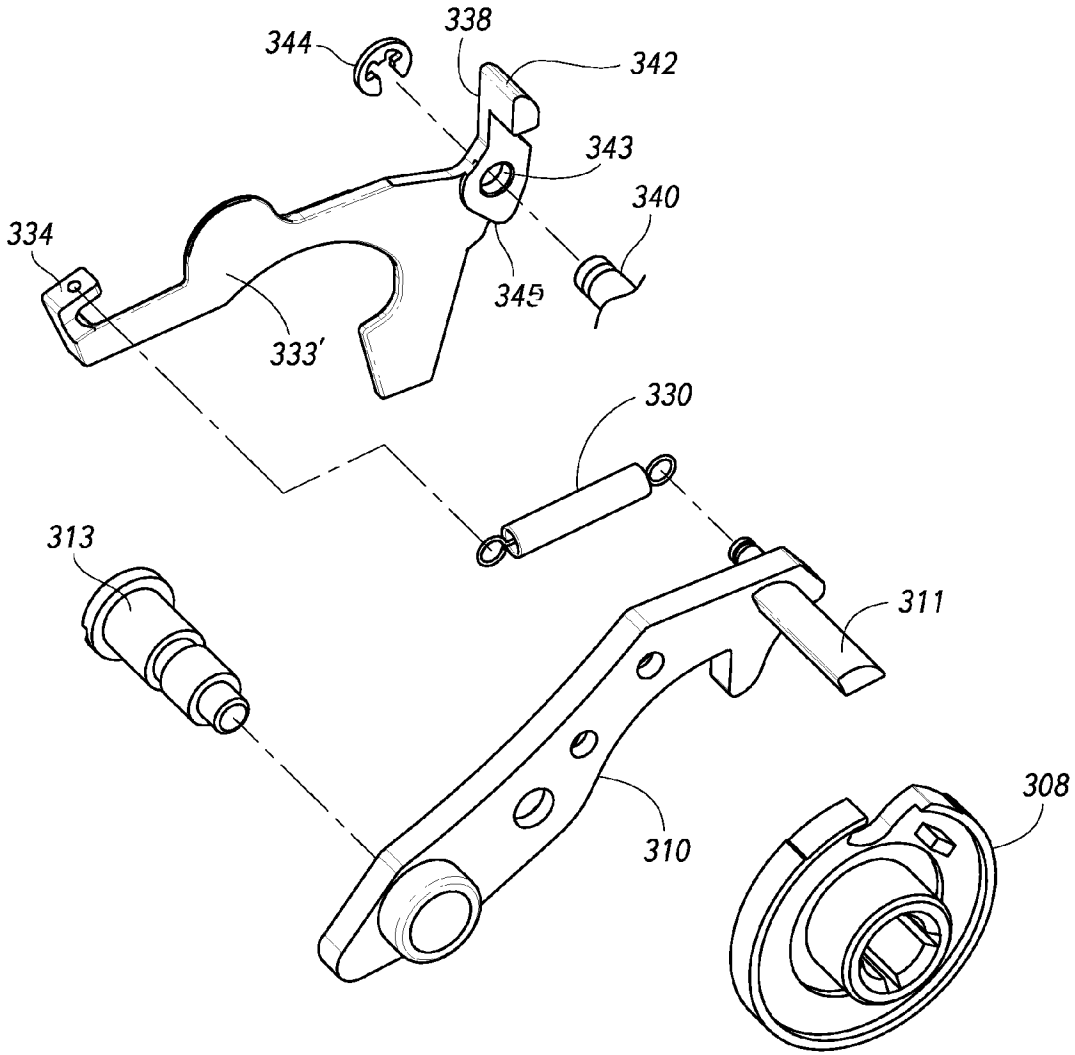
FIG. 12A shows an exploded view of the parts of a trigger plate and overcenter spring as assembled with the lever arm and the drive cam.

FIG. 12A is an exploded view of the structure of the preferred fence control feature, and shows the stop arm (338) with stop dog (342) in more detail. The underside of the trigger plate (333') is smooth across the apron for slidingly contacting the moving parts of the lever arm (310) and drive cam (308) without catching, but is reinforced around the pivot hole (343), which rotates on pin (331) and is secured as shown here with a circlip (344). Lip (345) provides clearance between the trigger plate and the drive cam.

Also shown in FIG. 12A is a detail of the integral bracket (334) for securing the overcenter spring to the trigger plate. The bracket offsets the action of the spring so that force is directed on an X-Y plane of rotation without a significant Z-vector. The bracket is displaced counterclockwise from the rotational line of the overcenter arm by a distance of about 4 mm, a feature that increases the sensitivity of the spring to displacement of the cam follower arm and reduces spring stretch, thereby sharpening the transitional arc from first position to second position.

While the plastic trigger plate is bendable, it is resilient and quickly returns to its native conformation. The plastic also contributes to the quietness of the fence action and has an advantage in translucency, permitting observation of the workings during servicing.

Figure 12C:
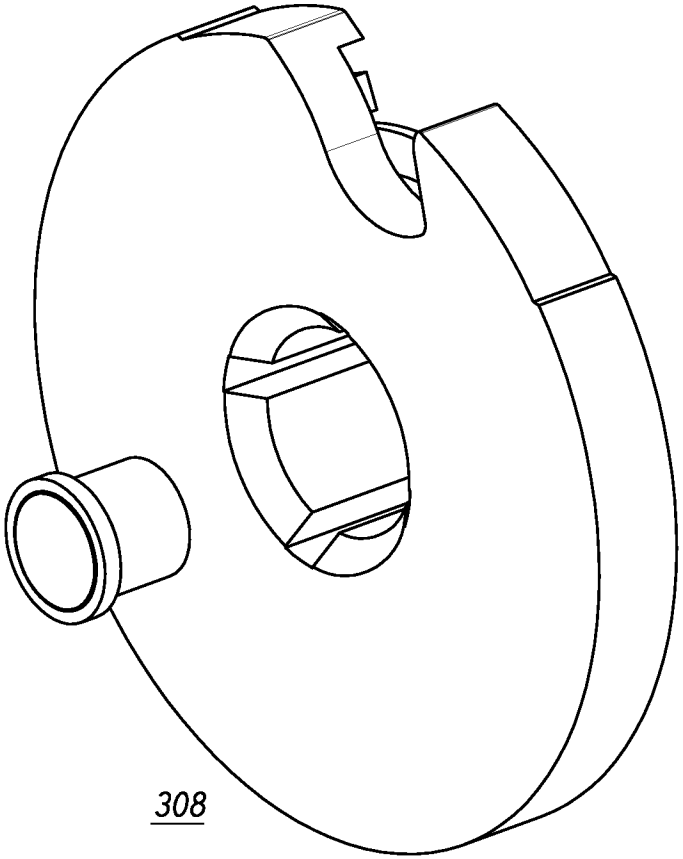
FIG. 12C is a detailed perspective view of an exemplary drive cam.
Figure 12B:
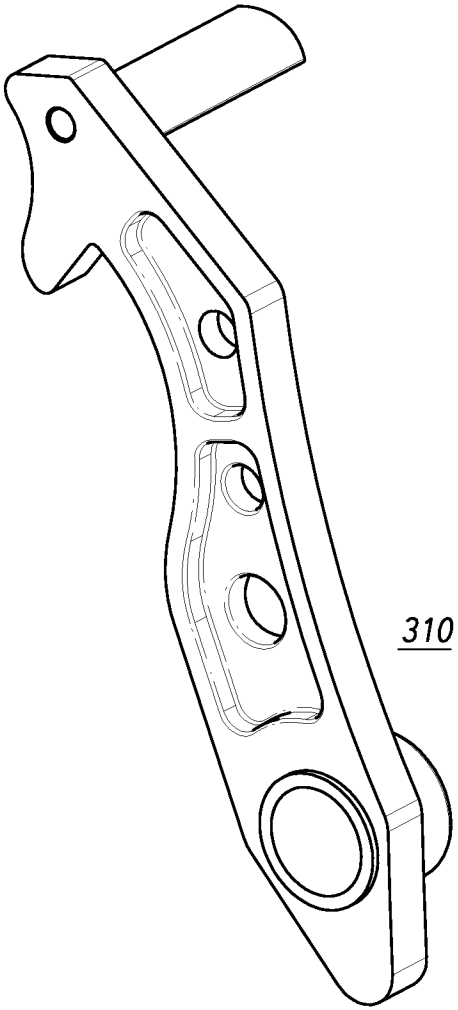
FIG. 12B is a detailed perspective view of an exemplary lever arm.
Figures 13A, 13B:
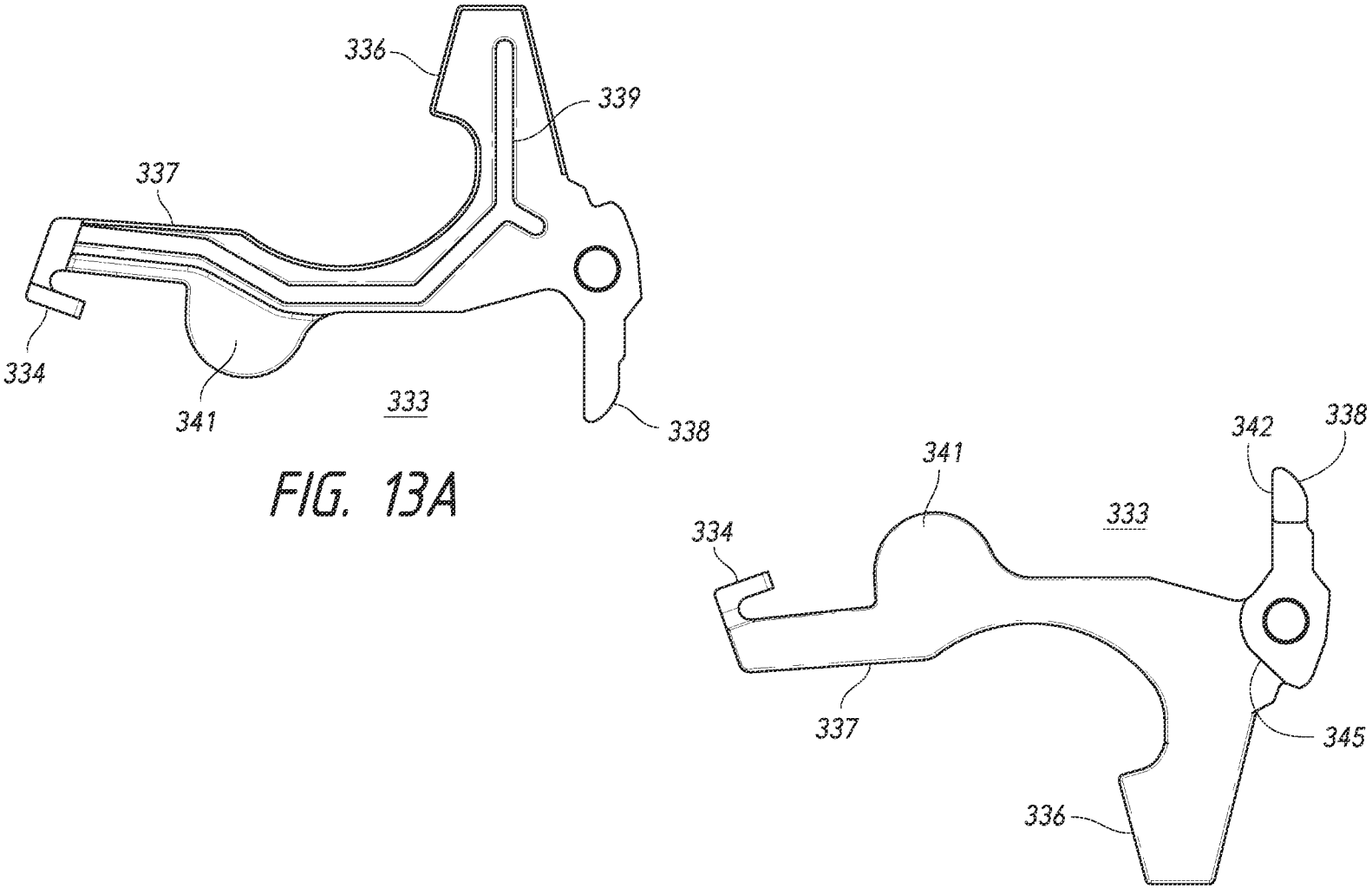
FIGS. 13A through 13D are detailed views taken from different angles of an exemplary trigger plate.
Figure 13D:
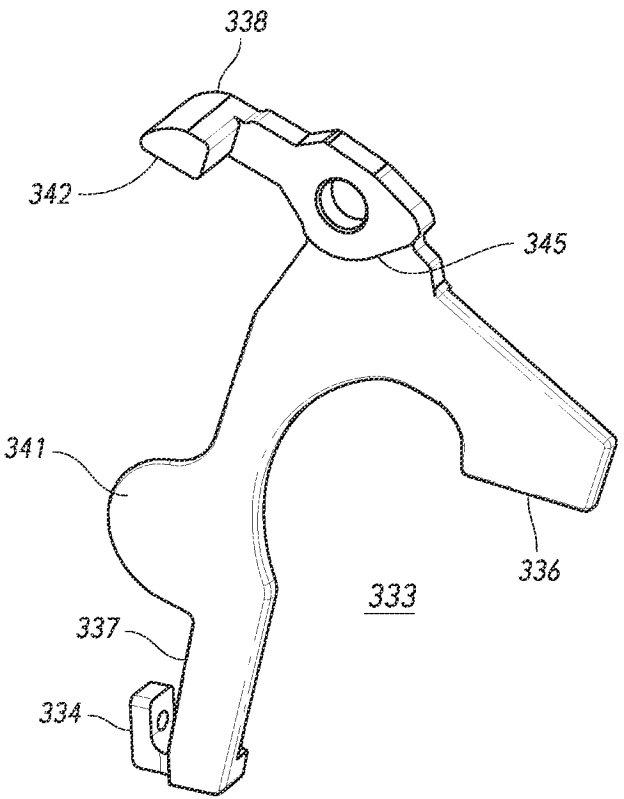
Figure 13C:
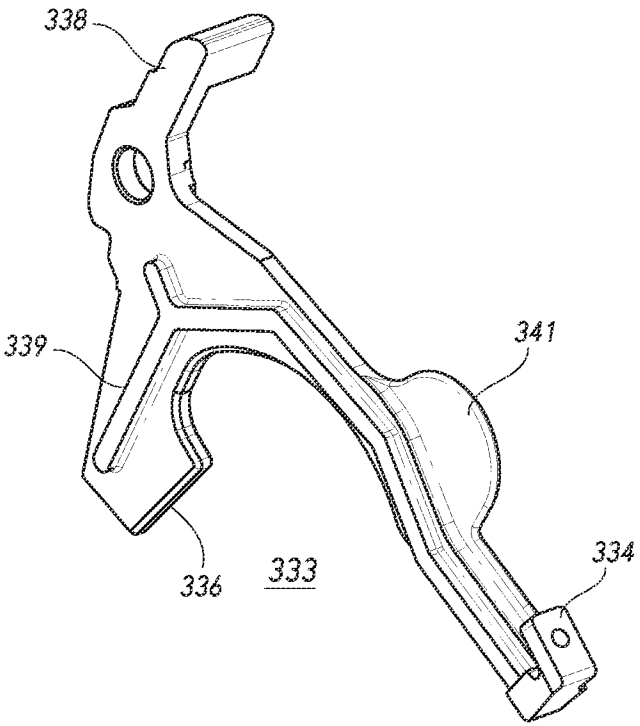

The fence lever arm (310) pivots on pivot pin (313) as previously described. Detailed views of the lever arm (310) and drive cam (308) are shown in FIGS. 12B and 12C respectively. The drive cam is secured to a drive shaft (not shown) that is operatively turned using the combination dial.

FIGS. 13A through 13D provide additional views of the trigger plate, showing cam follower arm (336), overcenter arm (337), stop arm (338) with stop dog (342), skirt (341), raised rib (339), and lip (345).

It is common in combination locks for the fence lever nose (112) to ride normally on the outer circumference of the drive cam. However, a skilled manipulator can feel the outline of the tumbler and drive cam gates and can deduce the combination. Therefore, considerable effort has been made to develop a "fence control mechanism" for dampening telltale interactions of the fence (111) and lever arm nose (112) with the tumbler wheel assembly gates and drive cam gate. Exemplary attempts to develop a "fence control mechanism" are described in U.S. Pat. No. 3,045,466 (the "Herlong reference") and U.S. Pat. No. 4,756,176 to Uyeda (the "Uyeda '176 reference"). As depicted in FIGS. 3 and 4 of the Uyeda '176 reference, a fence lever control device includes a biasing means, as shown, for normally biasing the lever to an inactive first position, and once each revolution of the dial, biasing the lever to a second position for contacting the drive cam and tumbler wheel assemblies. According to Uyeda, the biasing means consist of a spring connected at one end to the fence lever arm (110) and an overcenter acting arm connected to a second end of the spring, where the overcenter mounting arm is provided with an actuator means, consisting of a cam follower arm and a trigger pin mounted on the cam wheel. Uyeda goes on to relate, "if the combination has not been correctly entered and the gate wheel assemblies are not aligned to receive the fence, the fence will be held up by engagement with the outer peripheries of the wheel assemblies as the cam wheel gate passes beneath the nose of the fence lever and the spring connected between the fence and the overcenter arm will shift the overcenter arm away from its second position back into its first position" (column 2, lines 41-49). A combination lock with brass overcenter arm is commercially available.

However, in following the teachings of Uyeda, the description was not found to result in a smoothly working model.

Difficulties were also found when the overcenter arm was pinned between the lever arm nose and the drive cam! After almost a year of trials, a spring having a substantially shorter working distance than the Uyeda spring, and a weaker spring constant, when combined with a plastic trigger arm having an isolating skirt or apron was found to achieve a very sharp transition from a first position to a second position with whisper-like control of cam and wheel contact with the fence, spending less than 35 degrees of rotational arc in the second position.

In contrast, the commercially available brass mechanism, marketed by LaGard, was observed to approach the drive cam well before the drive cam gate's arrival and to return to the first position only after the drive cam gate had passed, thus working so that the fence remains in contact with the gate wheels for a significant fraction of a revolution.

Figure 14:
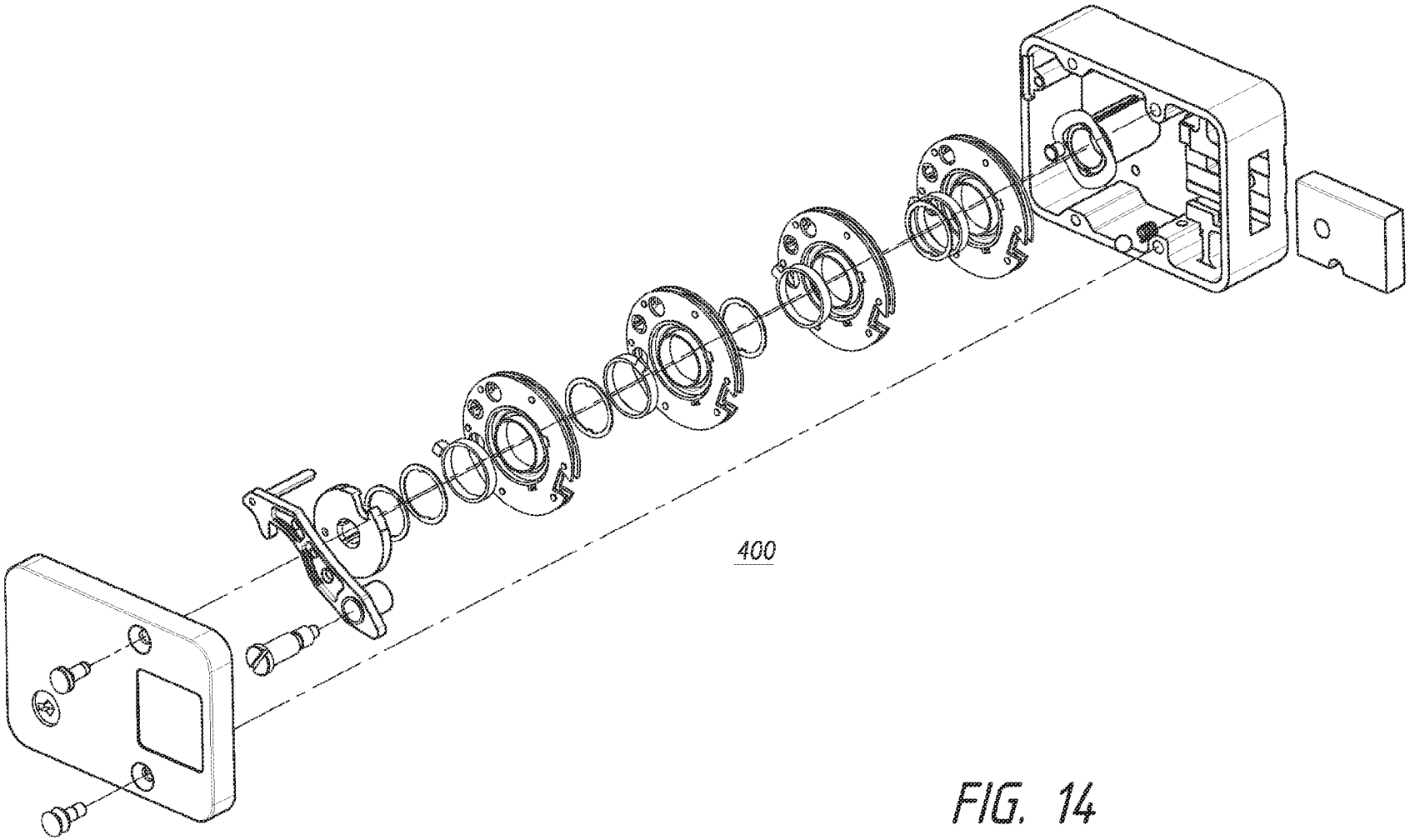
FIG. 14 is an exploded view of a generally representative combination lock with four tumbler wheel assemblies.
Figure 15:
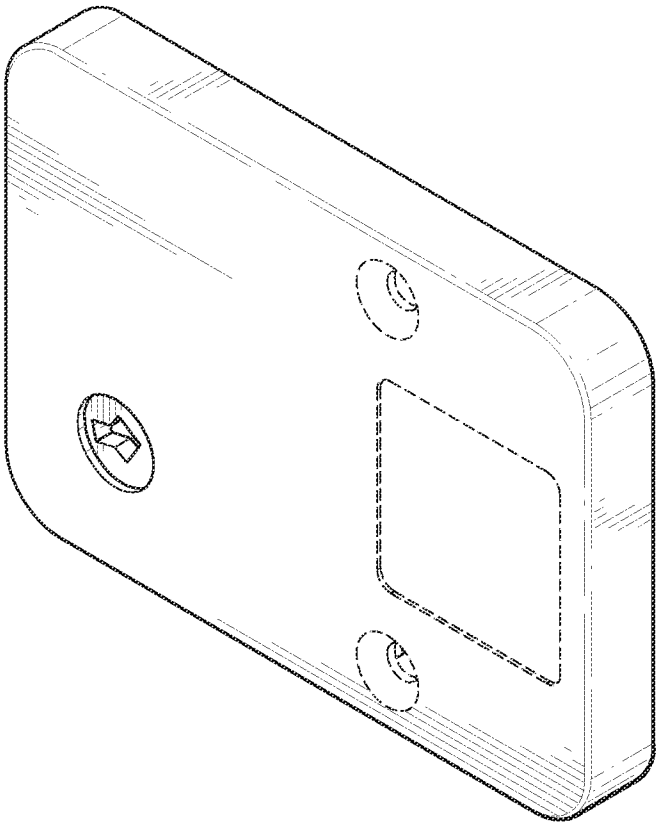
FIG. 15 is a perspective view of the outer surface of an exemplary lock case lid.
Figure 17:
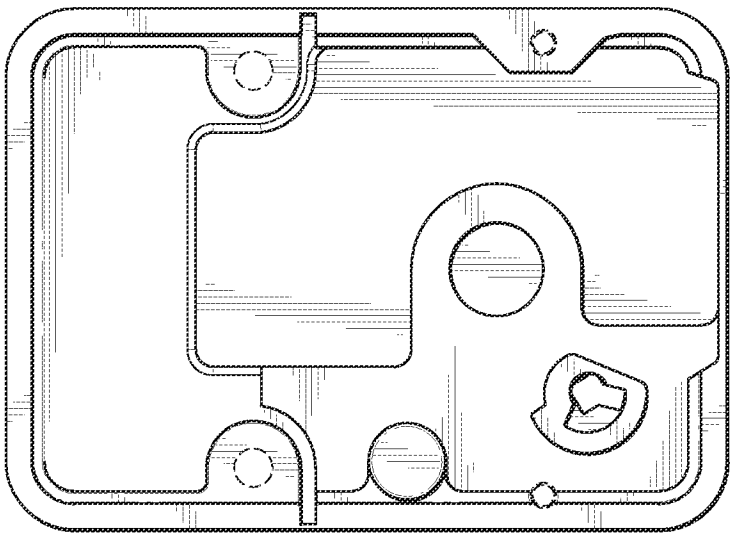
FIG. 17 is a plan view of the inner surface of the exemplary lock case lid of FIG. 15.
Figure 16:
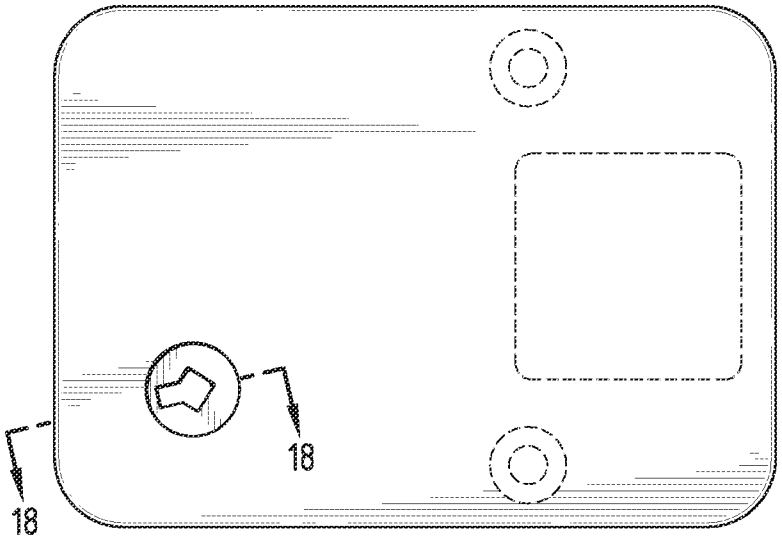
FIG. 16 is a plan view of the outer surface of the exemplary lock case lid of FIG. 15.
Figure 18:
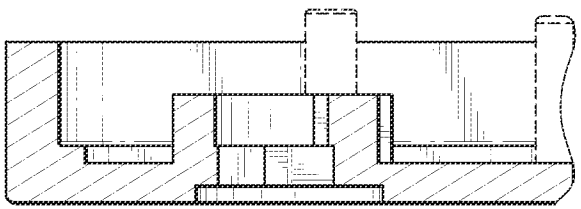
FIG. 18 is a cross-sectional detailed view of the keyhole and internal boss taken along lines 18-18 of FIG. 16.

FIG. 14 depicts a 4-wheel combination lock (400) of an exemplary preferred locking system. The lock tumblers may contain the micro-fingered interlock mechanism disclosed herein. The 4-wheel combination lock may also be fitted with an interchangeable duress feature and microswitch on one of the wheels, and/or a fence control feature as described in relation to FIGS. 10 through 13.

The inventive features described here may be used individually, in combinations of pairs, or all together. When used in pairs, the combination locks of the invention may employ a micro-fingered interlock mechanism with an interchangeable duress wheel, a micro-fingered interlock mechanism with a fence control feature, or a fence control feature in combination with an interchangeable duress wheel and microswitch. The duress wheel may be the #1 wheel, the #2 wheel, the #3 wheel, or the #4 wheel and may be optionally interchangeable by the user. In a preferred combination, the micro-fingered interlock mechanism is combined with a fence control feature, and optionally with an interchangeable duress wheel and microswitch at the customer's option. The inventive locks of the invention may also be combined with safes, automated cash machines, or other enclosures and sold as combinations therewith, adding economic value beyond the mere ratio of the component price.

It is to be understood that the inventions, examples, and embodiments described herein are not limited to particularly exemplified materials, methods, and/or structures. Further, all foreign and/or domestic publications, patents, and patent applications cited herein, whether supra or infra, are hereby incorporated by reference in their entirety.

The terms and expressions that have been employed in the foregoing specification are used as terms of description and not of limitation, and are not intended to exclude equivalents of the features shown and described. While the above is a complete description of selected embodiments of the present invention, it is possible to practice the invention using various alternatives, modifications, adaptations, variations, and/or combinations and their equivalents. It will be appreciated by those of ordinary skill in the art that any arrangement that is calculated to achieve the same purpose may be substituted for the specific embodiment shown. It is also to be understood that the following claims are intended to cover all of the generic and specific features of the invention herein described and all statements of the scope of the invention which, as a matter of language, might be said to fall therebetween.

What is claimed is:

1. A combination lock with a combination dial operatively linked to a drive cam and a plurality of tumbler wheel assemblies rotatably stacked on a hub to form a tumbler stack within a lock case, each of said plurality of tumbler wheel assemblies having a tumbler gate, said drive cam having a drive cam gate for engaging a nose of a pivotable fence lever arm, and said pivotable fence lever arm for retracting a slideable lock bolt when a correct combination is dialed, said combination lock comprising:

(a) a combination tumbler ring having an inside radius for engaging said hub and an outside circumference digitated with a plurality of tumbler ring micro-fingers, each of said plurality of tumbler ring micro-fingers having a tumbler ring micro-finger root and a tumbler ring micro-finger crown, said outside circumference having radius R' at said tumbler ring micro-finger root and radius R at said tumbler ring micro-finger crown;

(b) at least one interlock lever arm for opposingly contacting said outside circumference of said combination tumbler ring, each said at least one interlock lever arm having a first end and a second end, each said at least one interlock lever arm having a fulcrum, said first end of each said at least one interlock lever arm having a plurality of interlock lever arm micro-fingers disposed on an arcuate member with a concave radius, each of said plurality of interlock lever arm micro-fingers having an interlock lever arm micro-finger root and an interlock lever arm micro-finger crown, said plurality of interlock lever arm micro-fingers for interdigitatingly engaging said plurality of tumbler ring micro-fingers; and (c) each of said plurality of opposing flat-on-flat flank faces being generally perpendicular to an angular direction of torque tangential to said outside circumference at radius R at the point at which each of said flat-on-flat flank faces intersect said outside circumference where said plurality of tumbler ring micro-fingers and said plurality of interlock lever arm micro-fingers interdigitatedly engaged;

wherein said plurality of tumbler ring micro-fingers and said plurality of interlock lever arm micro-fingers form a plurality of opposing crowns and roots and a plurality of opposing flat-on-flat flank faces for cooperatively resisting rotational torque when interdigitatedly engaged.

2. The combination lock of claim 1, wherein each said fulcrum is disposed between said first end and said second end of said at least one interlock lever arm, and further comprising a rotatable lug cam for applying a rotatable lug cam force to said second end for leveraging said at least one interlock lever arm.

3. The combination lock of claim 2, wherein said first end of said interlock lever arm further comprises a spring arm member for biasing said arcuate member to disengage said at least one interlock lever arm when said rotatable lug cam force is not applied.

4. The combination lock of claim 2, wherein said at least one interlock lever arm comprises a pair of interlock lever arms, and said fulcrum of each of said pair of interlock lever arms is configured for cooperatively exerting a pincer motion to grasp said combination tumbler ring such that said plurality of interlock lever arm micro-fingers interdigitedly engage said plurality of tumbler ring micro-fingers when said rotatable lug cam is rotated to apply said rotatable lug cam force to said second end.

5. The combination lock of claim 1, said plurality of interlock lever arm micro-fingers and said plurality of tumbler ring micro-fingers being configured for resisting greater than 100 inch-pounds of rotational torque when said plurality of interlock lever arm micro-fingers and said plurality of tumbler ring micro-fingers are interdigitatedly engaged.

6. The combination lock of claim 1, said plurality of interlock lever arm micro-fingers and said plurality of tumbler ring micro-fingers being dimensioned with a difference in width of at least 0.001 inches such that adjacent micro-fingers of said plurality of interlock lever arm micro-fingers and said plurality of tumbler ring micro-fingers can be interdigitedly engaged.

7. The combination lock of claim 1, wherein said lock case is provided with a lock case lid and said lock case lid is configured with a keyhole for receiving a winged change key, said keyhole having an internal boss for stabilizing alignment of said winged change key during use.

8. The combination lock of claim 1, wherein any one of said plurality of tumbler wheel assemblies is configured as a duress tumbler wheel assembly for actuating an alarm, said duress tumbler wheel assembly being capable of interaction with a microswitch module having a rollerswitch, said rollerswitch positioned with a clearance from a peripheral edge of said duress tumbler wheel assembly, wherein said alarm is actuated when at least part of said duress tumbler wheel assembly impinges on said rollerswitch.

9. The combination lock of claim 8, wherein said microswitch module having said rollerswitch is at least partially encompassed in a microswitch assembly, said microswitch module positionable within said microswitch assembly in a microswitch module position corresponding to a duress tumbler wheel position of said duress tumbler wheel assembly.

10. The combination lock of claim 8, wherein said microswitch module having said rollerswitch is at least partially encompassed in a microswitch assembly, said microswitch assembly further comprising interchangeable spacer blocks configured so that said microswitch module can be changeably positioned to interact with at least part of said duress tumbler wheel assembly at any level of said tumbler stack.

11. The combination lock of claim 1, further comprising:

(a) an excentric trigger pin mounted on an outside face of said drive cam; and (b) a trigger plate pivotably mounted at a lock case fulcrum on said lock case, said trigger plate having an overcenter arm, a stop arm, and a cam follower arm disposed around a common pivot point on said lock case, wherein said overcenter arm is operatively coupled to said pivotable fence lever arm by an overcenter spring such that said nose is normally biased to a first position raised above said drive cam and drops down toward said drive cam gate in a second position for less than 35 degrees of rotational arc when resiliently urged by said excentric trigger pin acting on said cam follower arm.

12. The combination lock claim 11, said trigger plate further comprising:

(a) a bracket for mounting said overcenter spring, wherein said bracket is vertically elevated above said overcenter arm and displaced from a rotational line of said overcenter arm by a distance of about 4 millimeters, the displacement reducing stretch of said overcenter spring and sharpening the transitional arc from said first position to said second position;

(b) a half-moon-shaped apron formed on said overcenter arm, said half-moon-shaped apron extending under said overcenter spring and over said nose and said drive cam gate;

(c) a plastic body, generally formed of nylon with glass fill, having translucency, resilience, and increased resistance to wear; and (d) said stop arm having a stop dog for opposing said lock case.

13. The combination lock claim 11, said trigger plate further comprising at least one feature selected from the group consisting of:

(a) a bracket for mounting said overcenter spring, wherein said bracket is vertically elevated above said overcenter arm and displaced from a rotational line of said overcenter arm by a distance of about 4 millimeters, the displacement reducing stretch of said overcenter spring and sharpening the transitional arc from said first position to said second position;

(b) a half-moon-shaped apron formed on said overcenter arm, said half-moon-shaped apron extending under said overcenter spring and over said nose and said drive cam gate; and (c) a plastic body, generally formed of nylon with glass fill, having translucency, resilience, and increased resistance to wear.

14. The combination lock of claim 11, wherein said overcenter spring is a ¾ inch Lee Spring Model LE014A04M or equivalent thereof.

15. The combination lock of claim 1, said crown of each of said plurality of tumbler ring micro-fingers and said crown of each of said interlock lever arm micro-fingers having a convex curvature, and said root of each of said plurality of tumbler ring micro-fingers and said root of each of said interlock lever arm micro-fingers having a concave curvature mirroring said convex curvature.

16. The combination lock of claim 1, each of said tumbler ring micro-finger root, said tumbler ring micro-finger crown, said interlock lever arm micro-finger root, and said interlock lever arm micro-finger crown being semi-circular.

17. The combination lock of claim 1, each of said tumbler ring micro-finger root, said tumbler ring micro-finger crown, said interlock lever arm micro-finger root, and said interlock lever arm micro-finger crown being semi-ovoid.

18. The combination lock of claim 1, said plurality of tumbler ring micro-fingers and said plurality of interlock lever arm micro-fingers formed to completely fill said plurality of opposing crowns and roots when interdigitatedly engaged.

19. The combination lock of claim 1, each of said tumbler ring micro-finger root, said tumbler ring micro-finger crown, said interlock lever arm micro-finger root, and said interlock lever arm micro-finger crown being semi-circular; and said plurality of tumbler ring micro-fingers and said plurality of interlock lever arm micro-fingers formed to completely fill said plurality of opposing crowns and roots when interdigitatedly engaged.

20. The combination lock of claim 1, each of said tumbler ring micro-finger root, said tumbler ring micro-finger crown, said interlock lever arm micro-finger root, and said interlock lever arm micro-finger crown being semi-ovoid; and said plurality of tumbler ring micro-fingers and said plurality of interlock lever arm micro-fingers formed to completely fill said plurality of opposing crowns and roots when interdigitatedly engaged.

21. A combination lock with a combination dial operatively linked to a drive cam and a plurality of tumbler wheel assemblies rotatably stacked on a hub to form a tumbler stack within a lock case, each of said tumbler wheel assemblies having a tumbler gate, said drive cam having a drive cam gate for engaging a nose of a pivotable fence lever arm, and said pivotable fence lever arm for retracting a slideable lock bolt when a correct combination is dialed, said combination lock comprising:

(a) a combination tumbler ring having an inside radius for engaging said hub and an outside circumference digitated with a plurality of tumbler ring micro-fingers, each of said plurality of tumbler ring micro-fingers having a tumbler ring micro-finger root and a tumbler ring micro-finger crown, said outside circumference having radius R' at said tumbler ring micro-finger root and radius R at said tumbler ring micro-finger crown; and (b) at least one interlock lever arm for opposingly contacting said outside circumference of said combination tumbler ring, each said at least one interlock lever arm having a first end and a second end, each said at least one interlock lever arm having a fulcrum, said first end of each said at least one interlock lever arm having a plurality of interlock lever arm micro-fingers disposed on an arcuate member with a concave radius, each of said plurality of interlock lever arm micro-fingers having an interlock lever arm micro-finger root and an interlock lever arm micro-finger crown, said plurality of interlock lever arm micro-fingers for interdigitatingly engaging said plurality of tumbler ring micro-fingers; and (c) any one of said plurality of tumbler wheel assemblies being configured as a duress tumbler wheel assembly for actuating an alarm, said duress tumbler wheel assembly being capable of interaction with a microswitch module having a rollerswitch, said rollerswitch positioned with a clearance from a peripheral edge of said duress tumbler wheel assembly, wherein said alarm is actuated when at least part of said duress tumbler wheel assembly impinges on said rollerswitch, said duress tumbler wheel assembly further comprising:

(i) a duress gate on a peripheral edge of at least one outer gate ring of said duress tumbler wheel assembly;

(ii) a Y-shaped duress lever arm, comprising:

(A) a first end including a first branch with a cam shoulder and a resilient spring tine second branch; and (B) a blocking arm second end;

(iii) a pivot pin generally at a midpoint between said first end and said second end; and (iv) said cam shoulder having a concealed position and an exposed position, said concealed position within said tumbler wheel assembly, said resilient spring tine second branch for urging said cam shoulder to said concealed position within said tumbler wheel assembly;

wherein said plurality of tumbler ring micro-fingers and said plurality of interlock lever arm micro-fingers form a plurality of opposing crowns and roots and a plurality of opposing flat-on-flat flank faces for cooperatively resisting rotational torque when interdigitatedly engaged.

22. The combination lock of claim 21, wherein said pivotable fence lever arm includes a fence that is capable of engaging said duress gate, and said blocking arm second end is positioned to occlude said duress gate when said cam shoulder is in said concealed position, and said blocking arm rotatingly urges said cam shoulder to said exposed position when displaced from said duress gate by the action of said fence engaging said duress gate, and further wherein said rotation can be reversed by the action of said resilient spring tine second branch without triggering said alarm.

23. The combination lock of claim 21, wherein said pivotable fence lever arm includes a fence that is capable of engaging said duress gate, and said blocking arm second end is positioned to occlude said duress gate when said cam shoulder is in said concealed position, and rotatingly urges said cam shoulder to said exposed position when displaced from said duress gate by the action of said fence engaging said duress gate.

24. The combination lock of claim 23, wherein said rollerswitch of said microswitch module is operatively engaged by said cam shoulder in said exposed position when said pivotable fence lever arm is pivoted to retract said slideable lock bolt, thereby triggering said alarm.

25. A combination lock with a combination dial operatively linked to a drive cam and a plurality of tumbler wheel assemblies rotatably stacked on a hub to form a tumbler stack within a lock case, each of said plurality of tumbler wheel assemblies having a tumbler gate, said drive cam having a drive cam gate for engaging a nose of a pivotable fence lever arm, and said pivotable fence lever arm for retracting a slideable lock bolt when a correct combination is dialed, said combination lock comprising:

(a) a combination tumbler ring having an inside radius for engaging said hub and an outside circumference digitated with a plurality of tumbler ring micro-fingers, each of said plurality of tumbler ring micro-fingers having a tumbler ring micro-finger root and a tumbler ring micro-finger crown, said outside circumference having radius R' at said tumbler ring micro-finger root and radius R at said tumbler ring micro-finger crown;

(b) at least one interlock lever arm for opposingly contacting said outside circumference of said combination tumbler ring, each said at least one interlock lever arm having a first end and a second end, each said at least one interlock lever arm having a fulcrum, said first end of each said at least one interlock lever arm having a plurality of interlock lever arm micro-fingers disposed on an arcuate member with a concave radius, each of said plurality of interlock lever arm micro-fingers having an interlock lever arm micro-finger root and an interlock lever arm micro-finger crown, said plurality of interlock lever arm micro-fingers for interdigitatingly engaging said plurality of tumbler ring micro-fingers; and (c) each of said tumbler ring micro-finger root, said tumbler ring micro-finger crown, said interlock lever arm micro-finger root, and said interlock lever arm micro-finger crown being semi-circular;

wherein said plurality of tumbler ring micro-fingers and said plurality of interlock lever arm micro-fingers form a plurality of opposing crowns and roots and a plurality of opposing flat-on-flat flank faces for cooperatively resisting rotational torque when interdigitatedly engaged.

26. The combination lock of claim 25, said plurality of tumbler ring micro-fingers and said plurality of interlock lever arm micro-fingers formed to completely fill said plurality of opposing crowns and roots when interdigitatedly engaged.

27. A combination lock with a combination dial operatively linked to a drive cam and a plurality of tumbler wheel assemblies rotatably stacked on a hub to form a tumbler stack within a lock case, each of said plurality of tumbler wheel assemblies having a tumbler gate, said drive cam having a drive cam gate for engaging a nose of a pivotable fence lever arm, and said pivotable fence lever arm for retracting a slideable lock bolt when a correct combination is dialed, said combination lock comprising:

(a) a combination tumbler ring having an inside radius for engaging said hub and an outside circumference digitated with a plurality of tumbler ring micro-fingers, each of said plurality of tumbler ring micro-fingers having a tumbler ring micro-finger root and a tumbler ring micro-finger crown, said outside circumference having radius R' at said tumbler ring micro-finger root and radius R at said tumbler ring micro-finger crown;

(b) at least one interlock lever arm for opposingly contacting said outside circumference of said combination tumbler ring, each said at least one interlock lever arm having a first end and a second end, each said at least one interlock lever arm having a fulcrum, said first end of each said at least one interlock lever arm having a plurality of interlock lever arm micro-fingers disposed on an arcuate member with a concave radius, each of said plurality of interlock lever arm micro-fingers having an interlock lever arm micro-finger root and an interlock lever arm micro-finger crown, said plurality of interlock lever arm micro-fingers for interdigitatingly engaging said plurality of tumbler ring micro-fingers; and (c) each of said tumbler ring micro-finger root, said tumbler ring micro-finger crown, said interlock lever arm micro-finger root, and said interlock lever arm micro-finger crown being semi-ovoid;

wherein said plurality of tumbler ring micro-fingers and said plurality of interlock lever arm micro-fingers form a plurality of opposing crowns and roots and a plurality of opposing flat-on-flat flank faces for cooperatively resisting rotational torque when interdigitatedly engaged.

28. The combination lock of claim 27, said plurality of tumbler ring micro-fingers and said plurality of interlock lever arm micro-fingers formed to completely fill said plurality of opposing crowns and roots when interdigitatedly engaged.

29. A combination lock with a combination dial operatively linked to a drive cam and a plurality of tumbler wheel assemblies rotatably stacked on a hub to form a tumbler stack within a lock case, each of said plurality of tumbler wheel assemblies having a tumbler gate, said drive cam having a drive cam gate for engaging a nose of a pivotable fence lever arm, and said pivotable fence lever arm for retracting a slideable lock bolt when a correct combination is dialed, said combination lock comprising:

(a) a combination tumbler ring having an inside radius for engaging said hub and an outside circumference digitated with a plurality of tumbler ring micro-fingers, each of said plurality of tumbler ring micro-fingers having a tumbler ring micro-finger root and a tumbler ring micro-finger crown, said outside circumference having radius R' at said tumbler ring micro-finger root and radius R at said tumbler ring micro-finger crown;

(b) at least one interlock lever arm for opposingly contacting said outside circumference of said combination tumbler ring, each said at least one interlock lever arm having a first end and a second end, each said at least one interlock lever arm having a fulcrum, said first end of each said at least one interlock lever arm having a plurality of interlock lever arm micro-fingers disposed on an arcuate member with a concave radius, each of said plurality of interlock lever arm micro-fingers having an interlock lever arm micro-finger root and an interlock lever arm micro-finger crown, said plurality of interlock lever arm micro-fingers for interdigitatingly engaging said plurality of tumbler ring micro-fingers; and (c) said plurality of tumbler ring micro-fingers and said plurality of interlock lever arm micro-fingers formed to completely fill said plurality of opposing crowns and roots when interdigitatedly engaged;

wherein said plurality of tumbler ring micro-fingers and said plurality of interlock lever arm micro-fingers form a plurality of opposing crowns and roots and a plurality of opposing flat-on-flat flank faces for cooperatively resisting rotational torque when interdigitatedly engaged.

* * * * *